US012768146B2

(12) United States Patent
Itoh et al.

(10) Patent No.: US 12,768,146 B2
(45) Date of Patent: Oct. 20, 2026

(54) SUPPORT SYSTEM, INFORMATION PROCESSING DEVICE, AND STORAGE MEDIUM

(71) Applicant: SUMITOMO HEAVY INDUSTRIES, LTD., Tokyo (JP)

(72) Inventors: Takumi Itoh, Kanagawa (JP); Masaru Onodera, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 167 days.

(21) Appl. No.: 18/465,488

(22) Filed: Sep. 12, 2023

(65) Prior Publication Data

US 2023/0417023 A1 Dec. 28, 2023

Related U.S. Application Data

(63) Continuation of application No. PCT/JP2022/010664, filed on Mar. 10, 2022.

(30) Foreign Application Priority Data

Mar. 16, 2021 (JP) ..... 2021-042903

(51) Int. Cl.
*E02F 9/26* (2006.01)
*E02F 9/20* (2006.01)

(52) U.S. Cl.
CPC ..... *E02F 9/261* (2013.01); *E02F 9/205* (2013.01)

(58) Field of Classification Search
CPC ..... E02F 9/261; E02F 9/205; E02F 9/2054; E02F 9/20; G06Q 50/08
See application file for complete search history.

(56) References Cited

U.S. PATENT DOCUMENTS

| | | | | |
|---|---|---|---|---|
| 2016/0321763 | A1 | 11/2016 | Shike | |
| 2019/0003152 | A1 | 1/2019 | Nakamura et al. | |
| 2020/0173791 | A1* | 6/2020 | Misaki | G06Q 10/06 |
| 2020/0399862 | A1 | 12/2020 | Okazaki | |
| 2021/0254314 | A1 | 8/2021 | Takata et al. | |
| 2021/0381203 | A1 | 12/2021 | Itoh et al. | |

(Continued)

FOREIGN PATENT DOCUMENTS

| | | |
|---|---|---|
| JP | 2014-148893 | 8/2014 |
| JP | 2014-185472 | 10/2014 |
| JP | 2017-014726 | 1/2017 |

(Continued)

OTHER PUBLICATIONS

English translation of Yamashita et al. (JP 2014185472) (Year: 2014).*

(Continued)

*Primary Examiner* — Kyle J Kingsland
(74) *Attorney, Agent, or Firm* — IPUSA, PLLC

(57) ABSTRACT

A support system includes a first storage unit configured to store information related to a plurality of processes performed by a work machine in a time series, the information including information associating previous and subsequent processes among the plurality of processes, and the plurality of processes including movement of earth and sand on the ground, movement of earth and sand from the ground, or both; and a display unit configured to display the information related to the plurality of processes.

16 Claims, 18 Drawing Sheets

(56) References Cited

U.S. PATENT DOCUMENTS

2023/0229986 A1* 7/2023 Cami ..... G06Q 10/06312
705/7.15

FOREIGN PATENT DOCUMENTS

| | | |
|---|---|---|
| JP | 6496182 | 4/2019 |
| JP | 2019-108721 | 7/2019 |
| JP | 2019-157600 | 9/2019 |
| JP | 2019-167691 | 10/2019 |
| JP | 2020-040519 | 3/2020 |
| WO | 2020/175645 | 9/2020 |

OTHER PUBLICATIONS

International Search Report for PCT/JP2022/010664 mailed on May 17, 2022.

* cited by examiner

SUPPORT SYSTEM, INFORMATION PROCESSING DEVICE, AND STORAGE MEDIUM

CROSS-REFERENCE TO RELATED APPLICATION

The present application is a continuation application of International Application No. PCT/JP2022/010664, filed Mar. 10, 2022, which claims priority to Japanese Patent Application No. 2021-042903 filed Mar. 16, 2021. The contents of these applications are incorporated herein by reference in their entirety.

BACKGROUND OF THE INVENTION

1. Field of the Invention

The present disclosure relates to a support system or the like.

2. Description of the Related Art

For example, there has been known a computer system capable of calculating data related to an entire construction plan from start to completion of construction at a work site.

SUMMARY OF INVENTION

Problem to be Solved by Invention

However, in a process schedule included in construction plan data, although a progress of process from a macro viewpoint, such as an entire work site or an entire construction period, is clear, for example, a specific progress of an individual work performed by a work machine through a specific work machine or a specific operator may not be clear. For this reason, for example, an operator with a low degree of skill may not know an order of a plurality of tasks or a content of a task after a certain task, and work efficiency at the work site may decrease.

In view of the above-described problem, an object of the present invention is to provide a technology capable of improving work efficiency at a work site from a microscopic viewpoint.

Means for Solving the Problem

In order to achieve the above-described purpose, according to an embodiment of the present disclosure, a support system including a first storage unit configured to store information related to a plurality of processes performed by a work machine in a time series, the information including information associating previous and subsequent processes among the plurality of processes; and a display unit configured to display the information related to the plurality of processes, is provided.

According to another embodiment of the present disclosure, an information processing device including a first storage unit configured to store information related to a plurality of processes performed by a work machine in a time series, the information including information associating previous and subsequent processes among the plurality of processes; and a transmission unit configured to transmit information related to the plurality of processes, so as to be displayed on a predetermined device used by a user, is provided.

According to yet another embodiment of the present disclosure, a program that causes a terminal device to execute a request step of transmitting a signal to an external information processing device in response to a predetermined input, the signal requesting transmission of information related to a plurality of processes performed by a work machine in a time series, and the information including information associating previous and subsequent processes among the plurality of processes; and a control step of displaying on a display unit the information related to the plurality of processes, the information being transmitted from the information processing device in response to the signal, is provided.

Effects of the Invention

According to the above-described embodiment, it is possible to improve work efficiency at a work site from a microscopic viewpoint.

BRIEF DESCRIPTION OF DRAWINGS

Other objects and further features of the present disclosure will be apparent from the following detailed description when read in conjunction with the accompanying drawings, in which.

DESCRIPTION OF EMBODIMENTS

Hereinafter, embodiments will be described with reference to drawings.

[Outline of Management System]

First, an outline of a management system SYS according to the present embodiment will be described with reference to FIG. 1.

Figure 1:
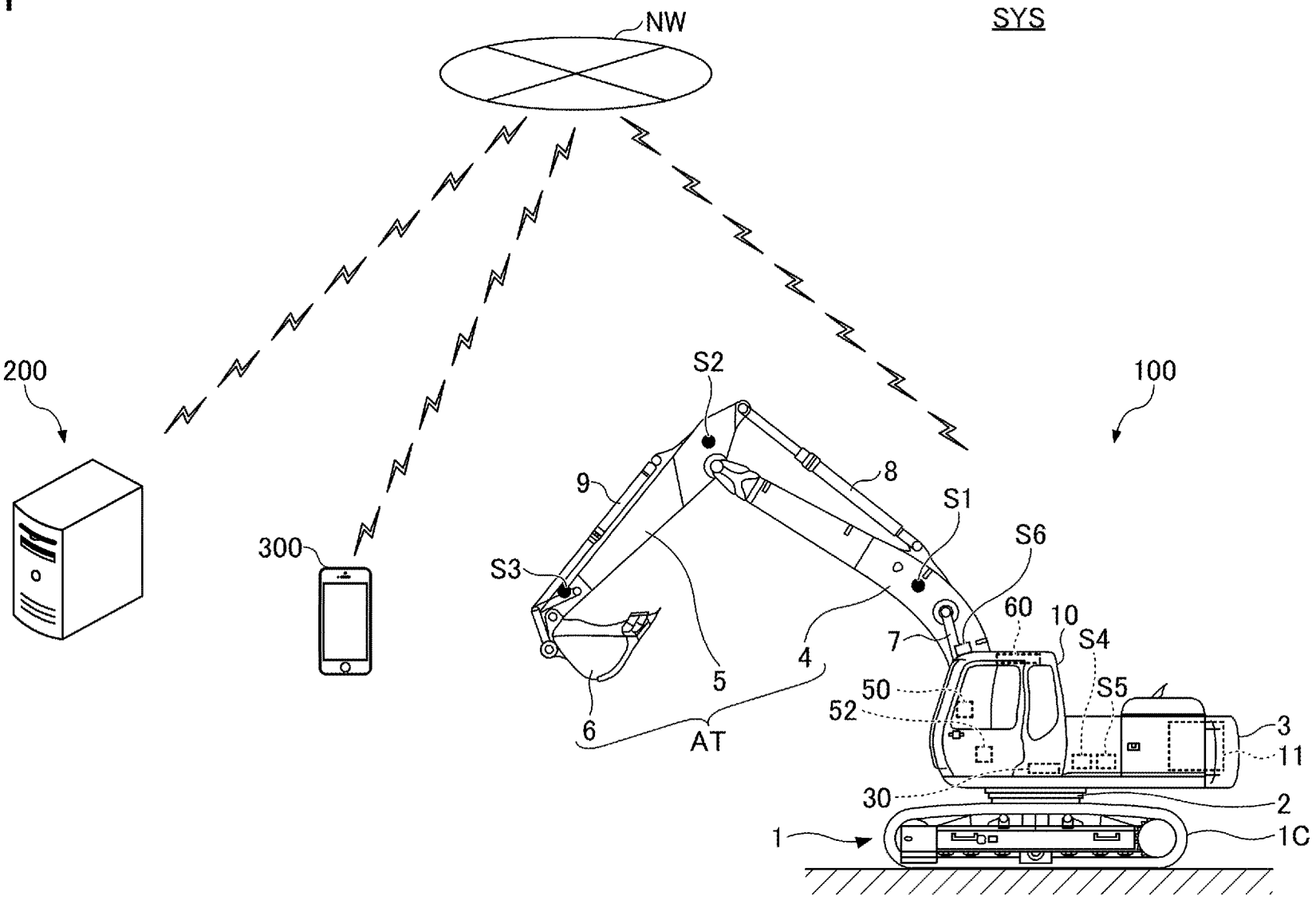
FIG. 1 is a schematic diagram illustrating an example of a management system.

FIG. 1 is a schematic diagram illustrating an example of the management system SYS according to the present embodiment.

As illustrated in FIG. 1, the management system SYS (an example of a support system) includes a shovel 100, a management device 200, and a terminal device 300.

The management system SYS may include a single shovel 100, or may include a plurality of shovels 100. Similarly, the management system SYS may include a single management device 200, or may include a plurality of management devices 200. Similarly, the management system SYS may include a single terminal device 300, or may include a plurality of terminal devices 300.

For example, the plurality of management devices 200 may perform processing related to the management system SYS in a distributed manner. Specifically, each of the plurality of management devices 200 may perform mutual communication with a part of the shovels 100 in charge among all the shovels 100 included in the management system SYS, and may perform processing on the part of the shovels 100. Similarly, each of the plurality of management devices 200 may perform mutual communication with a part of the terminal devices 300 in charge among all the terminal devices 300 included in the management system SYS, and may perform processing on the part of the terminal devices 300.

In the management system SYS, for example, the management device 200 collects information from the shovel 100 and monitors various states of the shovel 100 (for example, presence or absence of abnormality of various devices mounted on the shovel 100).

The management system SYS may support a remote operation of the shovel 100 in the management device 200, for example.

In addition, for example, as described later, when the shovel 100 performs work by complete automatic operation, the management system SYS may support remote monitoring of work by complete automatic operation of the shovel 100 in the management device 200.

In addition, for example, the management system SYS may distribute information related to the shovel 100 from the management device 200 to the shovel 100 and the terminal device 300 to provide information to a user (operator) of the shovel 100 and a user of the terminal device 300. The user of the terminal device 300 includes, for example, the operator of the shovel 100, and a supervisor who remotely monitors the shovel 100 that is completely automatically operated. Specifically, the management system SYS may distribute, to the shovel 100 and the terminal device 300, image information for supporting work by the shovel 100 (hereinafter, referred to as "work support image"). Thus, the management system SYS can provide the work support image to the user through the display device 50A of the shovel 100 or the output device 340 (display device) of the terminal device 300.

The work support image may be a still image or a moving image. Further, the work support image may be configured by a slide show of a plurality of still images.

The work support image is image information for supporting work of the shovel 100 including a plurality of processes.

For example, the work support image includes image information for supporting work of the shovel 100 including a plurality of work processes including a process of a main work; and a process of a preliminary work for preparation before the main work, a process of a post-work after the main work, or both. Hereinafter, the work support image in this form may be referred to as a "first work support image" (see FIG. 4).

In addition, for example, the work support image includes image information for supporting a series of repetitive work of the shovel 100 including a plurality of operation processes. The series of repetitive work of the shovel 100 is, for example, excavation work or loading work of the shovel 100. Hereinafter, the work support image in this form may be referred to as a "second work support image" (see FIG. 5).

In addition, for example, the work support image includes image information for supporting work of the shovel 100 configured by a plurality of work processes that are performed at different places in the work site, order of the plurality of work processes being changeable. The plurality of work processes may be the same type of work processes (for example, excavation work), or may be at least partially different types of work processes (for example, excavation work and rolling compaction work). Hereinafter, the work support image in this form may be referred to as a "third work support image" (see FIGS. 6 to 11).

In addition, for example, the work support image is image information for supporting work of the shovel 100 including a plurality of work processes in which the order of work is fixed. The plurality of work processes in which the order of work is fixed include, for example, a work process group including an excavation work, a burying work, and a backfilling work for burying an object such as an underground pipe such as a water pipe in the ground. Hereinafter, the work support image in this form may be referred to as a "fourth work support image" (see FIGS. 12 to 15).

<Outline of Shovel>

As shown in FIG. 1, the shovel 100 (an example of a work machine or a predetermined device) according to the present embodiment includes a lower traveling body 1, an upper pivot body 3 pivotably mounted on the lower traveling body 1 through a pivot mechanism 2, an attachment AT for performing various kinds of work, and a cabin 10. Hereinafter, the front side of the shovel 100 (upper pivot body 3) corresponds to a direction in which the attachment extends with respect to the upper pivot body 3 when the shovel 100 is viewed in a plan view (top view) from directly above along the pivot axis of the upper pivot body 3. The left side and the right side of the shovel 100 (the upper pivot body 3) correspond to the left side and the right side as viewed from the operator seated on a cockpit in the cabin 10, respectively.

Note that the cabin 10 may be omitted in a case where the shovel 100 is remotely operated or is operated by complete automatic operation.

The lower traveling body 1 includes, for example, a pair of left and right crawlers 1C. In the lower traveling body 1, each crawler 1C is hydraulically driven by a left traveling hydraulic motor 1ML and a right traveling hydraulic motor 1MR (see FIGS. 2 and 3), thereby causing the shovel 100 to travel.

The upper pivot body 3 pivots with respect to the lower traveling body 1 by the pivot mechanism 2 being hydraulically driven by the pivot hydraulic motor 2A.

The attachment AT includes a boom 4, an arm 5, and a bucket 6.

The boom 4 is attached to the center of the front portion of the upper pivot body 3 so as to be movable upward and downward, the arm 5 is attached to the tip end of the boom 4 rotatably upward and downward, and the bucket 6 is attached to the tip end of the arm 5 rotatably upward and downward.

The bucket 6 is an example of an end attachment. The bucket 6 is used for, for example, excavation work. In addition, instead of the bucket 6, another end attachment may be attached to the tip end of the arm 5 depending on the work content or the like. The other end attachment may be another type of bucket, such as a large bucket, a slope bucket, or a dredging bucket. In addition, the other end attachment may be an end attachment of a type other than a bucket, such as an agitator, a breaker, or a grapple.

The boom 4, the arm 5, and the bucket 6 are hydraulically driven by a boom cylinder 7, an arm cylinder 8, and a bucket cylinder 9 as hydraulic actuators, respectively.

The cabin 10 is a cockpit which an operator boards, and is mounted on the front left portion of the upper pivot body 3.

The shovel 100 is equipped with a communication device 60 (see FIGS. 2 and 3), and can communicate with the management device 200 via a predetermined communication line NW. Accordingly, the shovel 100 can transmit (upload) various types of information to the management device 200 and receive various signals (for example, an information signal and a control signal) and the like from the management device 200.

The communication line NW includes, for example, a wide area network (WAN). The wide area network may include, for example, a mobile communication network terminated by a base station. The wide area network may include, for example, a satellite communication network that uses a communication satellite above the shovel 100. The wide area network may include, for example, the Internet. The communication line NW may include, for example, a local area network (LAN) of a facility or the like in which the management device 200 is installed. The local network may be a wireless line, a wired line, or a line including both. The communication line NW may include, for example, a short-range communication line based on a predetermined wireless communication system, such as WiFi or Bluetooth (registered trademark).

The shovel 100 operates an actuator (for example, a hydraulic actuator) in accordance with an operation of the operator who boards the cabin 10, and drives operation elements (hereinafter, "driven elements") such as the lower traveling body 1, the upper pivot body 3, the boom 4, the arm 5, and the bucket 6.

Further, instead of or in addition to being configured to be operable by the operator of the cabin 10, the shovel 100 may be configured to be remotely operable from the outside of the shovel 100. When the shovel 100 is remotely operated, an operator may be absent in the cabin 10. Hereinafter, description will be made assuming that the operation of the operator includes an operation on the operating device 26 by the operator of the cabin 10, a remote operation by an external operator, or both.

The remote operation includes, for example, an aspect in which the shovel 100 is operated by a user's (operator's) input related to the actuator of the shovel 100 performed in a predetermined external device (for example, the management device 200 or the terminal device 300). In this case, for example, the shovel 100 may transmit image information (hereinafter, referred to as a "peripheral image") of the periphery of the shovel 100 based on an output from an imaging device S6, described below, to the external device, and the image information may be displayed on a display device (hereinafter, referred to as a "remote operation display device") provided in the external device. The various information images (information screens) displayed on the output device 50 in the cabin 10 of the shovel 100 may also be displayed on the remote operation display device of the external device. Accordingly, the operator of the external device can remotely operate the shovel 100 while viewing display contents such as a peripheral image showing a state of the periphery of the shovel 100 and various information images displayed on the remote operation display device, for example. The remote operation display device may be a display device dedicated to remote operation or may be a display device used for other purposes. Then, the shovel 100 may operate the actuator in accordance with a remote operation signal indicating the content of the remote operation received from the external device, and drive the driven elements such as the lower traveling body 1, the upper pivot body 3, the boom 4, the arm 5, and the bucket 6.

The remote operation may include, for example, an aspect in which the shovel 100 is operated by a voice input, a gesture input, or the like from the outside to the shovel 100 by a person (for example, a worker) around the shovel 100. Specifically, the shovel 100 recognizes a voice uttered by the worker around the shovel 100 or the like, a gesture performed by the worker or the like, and the like through a voice input device (for example, a microphone), an imaging device, or the like mounted on the shovel 100 (reference machine). Then, the shovel 100 may operate the actuator in accordance with the content of the recognized voice, gesture, or the like, to drive the driven elements such as the lower traveling body 1, the upper pivot body 3, the boom 4, the arm 5, and the bucket 6.

In addition, the shovel 100 may automatically operate the actuator regardless of the content of the operation by the operator. Thus, the shovel 100 realizes a function of automatically operating at least a part of the driven elements such as the lower traveling body 1, the upper pivot body 3, the boom 4, the arm 5, and the bucket 6, that is, a so-called "automatic operation function" or "machine control (MC) function".

The automatic operation function may include a function of automatically operating a driven element (actuator) other than the driven element (actuator) to be operated in response to an operation or a remote operation by the operator on the operating device 26, that is, a so-called "semi-automatic operation function" or "operation-supported MC function". In addition, the automatic operation function may include a function of automatically operating at least a part of a plurality of driven elements (actuators) assuming that operation or remote operation of the operating device 26 by the operator is not present, that is, a so-called "complete automatic operation function" or "complete automatic MC function". When the complete automatic operation function is enabled in the shovel 100, the operator may be absent in the cabin 10. In addition, the semi-automatic operation function, the complete automatic operation function, or the like may include an aspect in which the operation content of a driven element (actuator) that is a target of automatic operation is automatically determined in accordance with a rule defined in advance. In addition, the semi-automatic operation function, the complete automatic operation function, or the like may include an aspect (so-called "autonomous driving function") in which the shovel 100 autonomously performs various determinations and the operation content of a driven element (hydraulic actuator) that is a target of the automatic operation is autonomously determined according to the determination result.

<Outline of Management Device>

The management device 200 (an example of an information processing device) performs management related to the shovel 100, such as management (monitoring) of a state of the shovel 100 and management (monitoring) of work of the shovel 100.

The management device 200 may be, for example, an on-premise server or a cloud server installed in a management center or the like outside a work site where the shovel 100 performs work. In addition, the management device 200 may be, for example, an edge server disposed in a work site where the shovel 100 performs work or in a place relatively close to the work site (for example, a station house of a communication provider or a base station). The management device 200 may be a stationary terminal device or a portable terminal device (mobile terminal) disposed in an administrative office or the like in a work site of the shovel 100. The stationary terminal device may include, for example, a desktop computer terminal. The portable terminal device may include, for example, a smartphone, a tablet terminal, or a laptop computer terminal.

The management device 200 includes, for example, a communication device 220 (see FIGS. 2 and 3), and communicates with the shovel 100 via the communication line NW as described above. Accordingly, the management device 200 can receive various types of information uploaded from the shovel 100 and transmit various signals to the shovel 100. Therefore, the user of the management device 200 can check various types of information related to the shovel 100 through the output device 240 (see FIGS. 2 and 3). For example, the management device 200 can transmit an information signal to the shovel 100 to provide information necessary for work, or transmit a control signal to the shovel 100 to control the shovel 100. The user of the management device 200 may include, for example, an owner of the shovel 100; a manager of the shovel 100; an engineer of a manufacturer of the shovel 100; an operator of the shovel 100; and a manager, a supervisor, and a worker of the work site of the shovel 100.

The management device 200 may be configured to be capable of supporting remote operation of the shovel 100. For example, the management device 200 may include an input device (hereinafter, referred to as a "remote operating device" for convenience) for an operator to perform a remote operation, and a remote operation display device that displays image information (peripheral image) of the periphery of the shovel 100 and the like. The signal input from the remote operating device is transmitted to the shovel 100 as a remote operation signal. Accordingly, the user (operator) of the management device 200 can remotely operate the shovel 100 using the remote operating device while checking the state of the periphery of the shovel 100 on the remote operation display device.

In addition, the management device 200 may be configured to be capable of supporting remote monitoring of the shovel 100 that performs work in a complete automatic operation. For example, the management device 200 may include a display device (hereinafter, referred to as a "monitoring display device") that displays image information (peripheral image) of the periphery of the shovel 100 or the like. The monitoring display device may be a display device dedicated to remote monitoring, or may be a display device used for other purposes. Accordingly, the user (supervisor) of the management device 200 can monitor the state of the work of the shovel 100 on the monitoring display device. In addition, for example, the management device 200 may include an input device (hereinafter, referred to as an "intervention operating device" for convenience) for performing an intervention operation in the operation by the automatic operation function of the shovel 100. The intervention operating device may include, for example, an input device for performing an emergency stop of the shovel 100. The intervention operating device may include the above-described remote operating device. Accordingly, when an abnormality occurs in the shovel 100, when the operation of the shovel 100 is inappropriate, or the like, the user (supervisor) of the management device 200 can perform an emergency stop of the shovel 100 or perform a remote operation for causing the shovel 100 to perform an appropriate operation.

<Outline of Terminal Device>

The terminal device 300 (an example of a predetermined device) is, for example, a user terminal used by an operator of the shovel 100, a supervisor of the shovel 100, or the like as described above.

The terminal device 300 may be, for example, a stationary terminal device of the shovel 100 or a portable (transportable) terminal device (mobile terminal) that can be carried by the user. The stationary terminal device may include, for example, a desktop computer terminal. The portable terminal device may include, for example, a smartphone, a tablet terminal, or a laptop computer terminal.

The terminal device 300 includes, for example, a communication device 320 (see FIGS. 2 and 3) and communicates with the management device 200 via the communication line NW. Accordingly, the terminal device 300 can receive various types of information related to the shovel 100 distributed from the management device 200 and transmit various signals to the management device 200. Therefore, the user of the terminal device 300 can check various types of information related to the shovel 100 through the output device 340 (see FIGS. 2 and 3). In addition, for example, the terminal device 300 can transmit a signal for requesting information distribution to the shovel 100 and request information distribution to the management device 200.

The terminal device 300 may be capable of communicating with the shovel 100 via the management device 200. The terminal device 300 may be capable of directly communicating with the shovel 100 without going via the management device 200.

The terminal device 300 may be configured to be capable of supporting remote operation of the shovel 100. For example, the terminal device 300 may include an input device (remote operating device) for an operator to perform remote operation, and a remote operation display device that displays image information (peripheral image) of the periphery of the shovel 100 and the like. The signal input from the remote operating device is transmitted to the shovel 100 as a remote operation signal. Accordingly, the user (operator) of the terminal device 300 can remotely operate the shovel 100 using the remote operating device while checking the state of the periphery of the shovel 100 on the remote operation display device.

In addition, the terminal device 300 may be configured to be capable of supporting remote monitoring of the shovel 100 that performs work in a complete automatic operation. For example, the terminal device 300 may include a display device (monitoring display device) that displays image information (peripheral image) of the periphery of the shovel 100 or the like. Accordingly, the user (supervisor) of the terminal device 300 can monitor the state of the work of the shovel 100 on the monitoring display device. In addition, for example, the terminal device 300 may include an input device (intervention operating device) for performing an intervention operation on the operation by the automatic operation function of the shovel 100. Accordingly, when an abnormality occurs in the shovel 100, when the operation of the shovel 100 is inappropriate, or the like, the user (supervisor) of the terminal device 300 can perform an emergency stop of the shovel 100 or perform a remote operation for causing the shovel 100 to perform an appropriate operation.

[Configuration of Management System]

Next, the configuration of the management system SYS will be described with reference to FIGS. 2 and 3.

Figure 2:
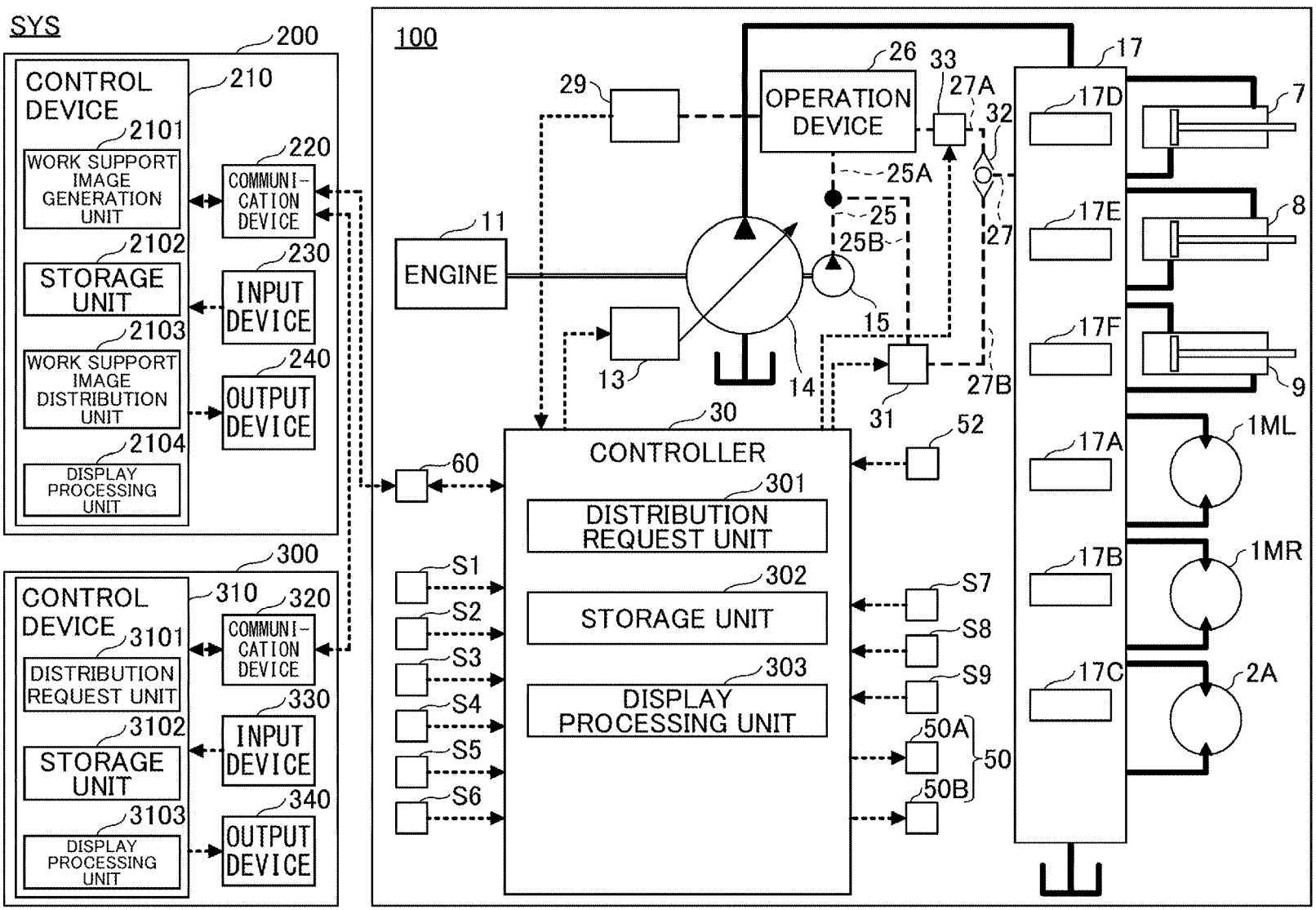
FIG. 2 is a block diagram illustrating an example of a configuration of the management system.
Figure 3:
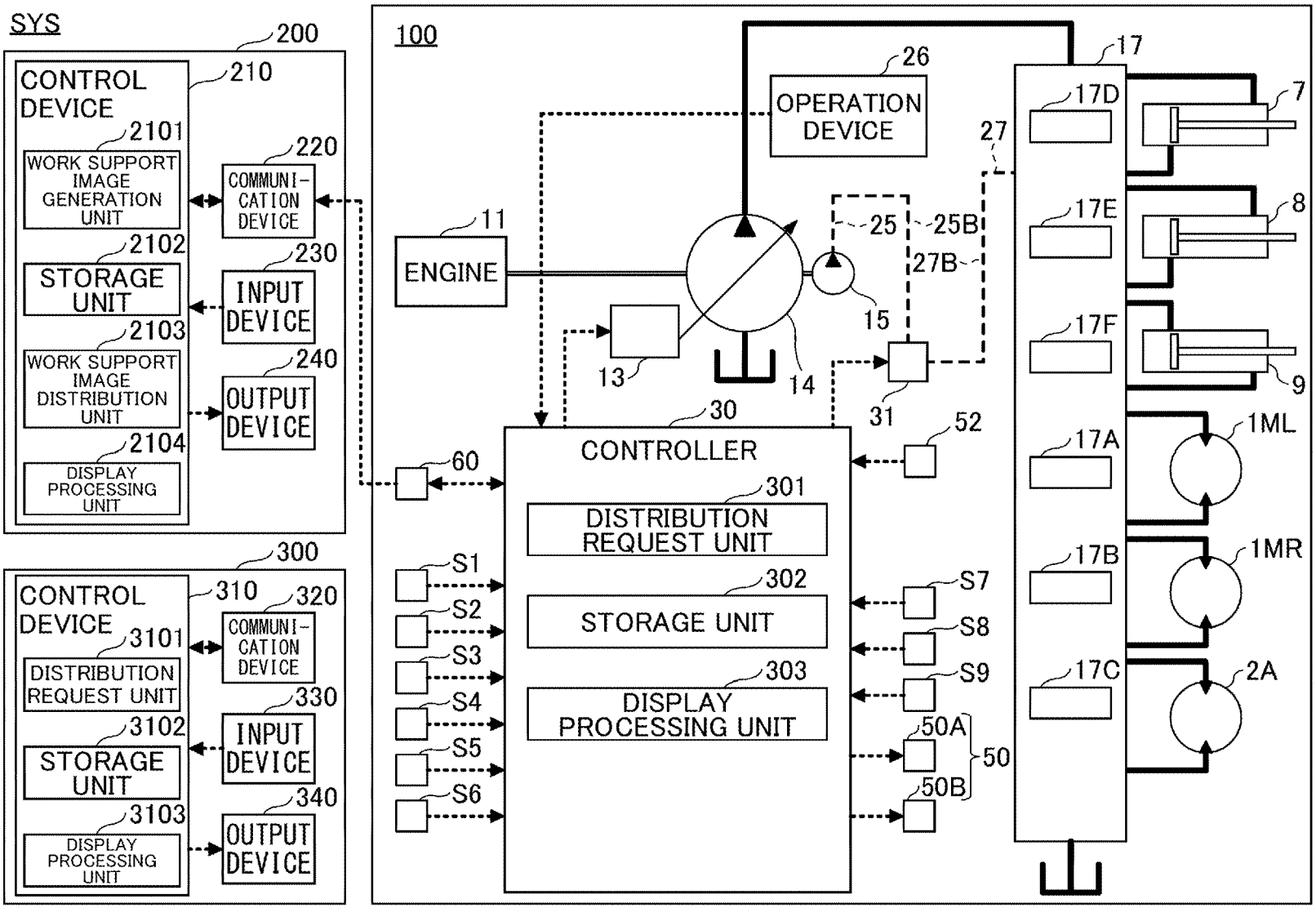
FIG. 3 is a block diagram illustrating another example of the configuration of the management system.

FIGS. 2 and 3 are block diagrams illustrating an example and another example of the configuration of the management system SYS according to the present embodiment. In FIGS. 2 and 3, a path through which mechanical power is transmitted is indicated by a double line, a path through which high-pressure hydraulic oil for driving the hydraulic actuator flows is indicated by a solid line, a path through which pilot pressure is transmitted is indicated by a broken line, and a path through which an electric signal is transmitted is indicated by a dotted line. FIGS. 2 and 3 are different from each other only in the configuration of the shovel 100 among the shovel 100, the management device 200, and the terminal device 300.

<Configuration of Shovel>

The shovel 100 includes components such as a hydraulic drive system related to hydraulic drive of a driven element, an operation system related to operation of the driven element, a user interface system related to exchange of information with a user, a communication system related to communication with the outside, and a control system related to various controls.

<<Hydraulic Drive System>>

As shown in FIGS. 2 and 3, the hydraulic drive system of the shovel 100 according to the present embodiment includes hydraulic actuators that hydraulically drive the respective driven elements such as the lower traveling body 1 (the left and right crawlers 1C), the upper pivot body 3, the boom 4, the arm 5, and the bucket 6 as described above. The hydraulic actuators include the traveling hydraulic motors 1ML and 1MR, the pivot hydraulic motor 2A, the boom cylinder 7, the arm cylinder 8, the bucket cylinder 9, and the like. The hydraulic drive system of the shovel 100 according to the present embodiment includes an engine 11, a regulator 13, a main pump 14, and a control valve 17.

The engine 11 is a prime mover and is a main power source in the hydraulic drive system. The engine 11 is, for example, a diesel engine that uses light oil as fuel. The engine 11 is mounted on, for example, a rear portion of the upper pivot body 3. The engine 11 constantly rotates at a preset target rotation speed under direct or indirect control by a controller 30 described later, and drives the main pump 14 and a pilot pump 15.

The regulator 13 controls (adjusts) a discharge amount of the main pump 14 under the control of the controller 30. For example, the regulator 13 adjusts an angle of a swash plate of the main pump 14 (hereinafter, referred to as a "tilt angle") in response to a control command from the controller 30.

The main pump 14 supplies hydraulic oil to the control valve 17 through a high-pressure hydraulic line. The main pump 14 is mounted, for example, on the rear portion of the upper pivot body 3 similarly to the engine 11. As described above, the main pump 14 is driven by the engine 11. The main pump 14 is, for example, a variable displacement hydraulic pump, and as described above, under the control of the controller 30, the title angle of the swash plate is adjusted by the regulator 13 so that a stroke length of the piston is adjusted, thereby the discharge flow rate (discharge pressure) is controlled.

The control valve 17 is a hydraulic control device that controls the hydraulic actuator in accordance with the content of an operation or a remote operation performed on the operating device 26 by an operator, or in accordance with an operation command related to an automatic operation function output from the controller 30. The control valve 17 is mounted on, for example, a central portion of the upper pivot body 3. As described above, the control valve 17 is connected to the main pump 14 via a high-pressure hydraulic line, and selectively supplies the hydraulic oil supplied from the main pump 14 to each of the hydraulic actuators in accordance with an operation of the operator or an operation command output from the controller 30. To be specific, the control valve 17 includes a plurality of control valves (also referred to as "direction switching valves") 17A to 17F that control a flow rate and a flow direction of the hydraulic oil supplied from the main pump 14 to each of the hydraulic actuators. Hereinafter, the control valves 17A to 17F may be collectively referred to as "control valve 17X", or any one of the control valves 17A to 17F may be individually referred to as a "control valve 17X".

The control valve 17A is configured to be capable of supplying hydraulic oil to the traveling hydraulic motor 1ML, and discharging hydraulic oil from the traveling hydraulic motor 1ML to return the hydraulic oil to the tank. Thus, the control valve 17B can drive the traveling hydraulic motor 1ML by the pilot pressure supplied from the operating device 26 or the hydraulic control valve 31.

The control valve 17B is configured to be capable of supplying hydraulic oil to the traveling hydraulic motor 1MR, and discharging hydraulic oil from the traveling hydraulic motor 1MR to return the hydraulic oil to the tank. Thus, the control valve 17B can drive the traveling hydraulic motor 1MR by the pilot pressure supplied from the operating device 26 or the hydraulic control valve 31.

The control valve 17C is configured to be capable of supplying hydraulic oil to the pivot hydraulic motor 2A, and discharging hydraulic oil from the pivot hydraulic motor 2A to return the hydraulic oil to the tank. Thus, the control valve 17C can drive the pivot hydraulic motor 2A by the pilot pressure supplied from the operating device 26 or the hydraulic control valve 31.

The control valve 17D is configured to be capable of supplying hydraulic oil to the boom cylinder 7, and discharging hydraulic oil from the boom cylinder 7 to return the hydraulic oil to the tank. Thus, the control valve 17D can drive the boom cylinder 7 in accordance with the pilot pressure supplied from the operating device 26 or the hydraulic control valve 31.

The control valve 17E is configured to be capable of supplying hydraulic oil to the arm cylinder 8, and discharging hydraulic oil from the arm cylinder 8 to return the hydraulic oil to the tank. Thus, the control valve 17E can drive the arm cylinder 8 by the pilot pressure supplied from the operating device 26 or the hydraulic control valve 31.

The control valve 17F is configured to be capable of supplying hydraulic oil to the bucket cylinder 9, and discharging hydraulic oil from the bucket cylinder 9 to return the hydraulic oil to the tank. Thus, the control valve 17F can drive the bucket cylinder 9 in accordance with the pilot pressure supplied from the operating device 26 or the hydraulic control valve 31.

The control valve 17X is, for example, a spool valve having two ports to which the pilot pressure is supplied. A spool movable in an axial direction is incorporated in the control valve 17X, and the spool is biased toward an opposite end portion so as to be balanced at a predetermined neutral position by spring members provided at both end portions of the spool.

When hydraulic oil is supplied to one port of the control valve 17X, a pressure of the hydraulic oil (pilot pressure) acts on one end of the spool in the axial direction, and the spool moves toward the other end side in the axial direction with reference to the neutral position. As a result, the control valve 17X can drive the hydraulic actuator in one direction by communicating a path for supplying hydraulic oil to one of the two hydraulic oil supply/discharge ports of the hydraulic actuator, and discharging hydraulic oil from the other port in accordance with the movement of the spool.

On the other hand, when hydraulic oil is supplied to the other port of the control valve 17X, a pressure of the hydraulic oil (pilot pressure) acts on the other end of the spool in the axial direction, and the spool moves toward the one end side in the axial direction with reference to the neutral position. As a result, the control valve 17X can drive the hydraulic actuator in another direction by communicating a path for supplying hydraulic oil to the other port of the two hydraulic oil supply/discharge ports of the hydraulic actuator, and discharging hydraulic oil from the one of the two hydraulic oil supply/discharge ports in accordance with the movement of the spool.

<<Operation System>>

As shown in FIGS. 2 and 3, the operation system of the shovel 100 according to the present embodiment includes the pilot pump 15, the operating device 26, and the hydraulic control valve 31. As shown in FIG. 2, the operation system of the shovel 100 according to the present embodiment includes a shuttle valve 32 and a hydraulic control valve 33 when the operating device 26 is a hydraulic pilot type.

The pilot pump 15 supplies a pilot pressure to various hydraulic devices via a pilot line 25. The pilot pump 15 is mounted on, for example, the rear portion of the upper pivot body 3 similarly to the engine 11. The pilot pump 15 is, for example, a fixed displacement hydraulic pump, and is driven by the engine 11 as described above.

Note that the pilot pump 15 may be omitted. In this case, a relatively low-pressure hydraulic oil, obtained by reducing a pressure of a relatively high-pressure hydraulic oil discharged from the main pump 14 by a predetermined pressure reducing valve, is supplied to various hydraulic devices as a pilot pressure.

The operating device 26 is provided in the vicinity of a cockpit of the cabin 10 and is used by the operator to operate various driven elements (the lower traveling body 1, the upper pivot body 3, the boom 4, the arm 5, the bucket 6, and the like). In other words, the operating device 26 is used by the operator to operate the hydraulic actuators that drive the respective driven elements (i.e., the traveling hydraulic motors 1ML and 1MR, the pivot hydraulic motor 2A, the boom cylinder 7, the arm cylinder 8, the bucket cylinder 9, and the like). The operating device 26 includes, for example, a lever device that operates each of the boom 4 (boom cylinder 7), the arm 5 (arm cylinder 8), the bucket 6 (bucket cylinder 9), and the upper pivot body 3 (pivot hydraulic motor 2A). The operating device 26 includes, for example, a pedal device or a lever device that operates each of the left and right crawlers (traveling hydraulic motors 1ML and 1MR) of the lower traveling body 1.

For example, as shown in FIG. 2, the operating device 26 is a hydraulic pilot type. To be more specific, the operating device 26 uses the hydraulic oil supplied from the pilot pump 15 through the pilot line 25 and a pilot line 25A branched therefrom, and outputs a pilot pressure corresponding to the operation content to the pilot line 27A on the secondary side. The pilot line 27A is connected to one of inlet ports of the shuttle valve 32 to a control valve 17 via the pilot line 27 connected to an outlet port of the shuttle valve 32. Thus, the pilot pressure corresponding to the operation content related to various driven elements (hydraulic actuators) in the operating device 26 can be input to the control valve 17 via the shuttle valve 32. Therefore, the control valve 17 can drive each hydraulic actuator in accordance with the operation content of the operating device 26 by the operator or the like.

Further, for example, as shown in FIG. 3, the operating device 26 is an electric type. Specifically, the operating device 26 outputs an electric signal (hereinafter, referred to as an "operation signal") corresponding to the operation content, and the operation signal is captured by the controller 30. Then, the controller 30 outputs a control command corresponding to the content of the operation signal, that is, a control signal corresponding to the content of the operation performed on the operating device 26 to the hydraulic control valve 31. Thus, the pilot pressure corresponding to the operation content of the operating device 26 is input from the hydraulic control valve 31 to the control valve 17, and the control valve 17 can drive each hydraulic actuator in accordance with the operation content of the operating device 26.

In addition, the control valves 17X (direction switching valves) that drive the respective hydraulic actuators and are built into the control valve 17 may be electromagnetic solenoid valves. In this case, the operation signal output from the operating device 26 may be directly input to the control valve 17, that is, the electromagnetic solenoid type control valve 17X.

The hydraulic control valve 31 is provided for each driven element (hydraulic actuator) to be operated by the operating device 26. That is, the hydraulic control valve 31 is provided, for example, for each of the left crawler (traveling hydraulic motor 1ML), the right crawler (traveling hydraulic motor 1MR), the upper pivot body 3 (pivot hydraulic motor 2A), the boom 4 (boom cylinder 7), the arm 5 (arm cylinder 8), and the bucket 6 (bucket cylinder 9). For example, the hydraulic control valve 31 may be provided in the pilot line 25B between the pilot pump 15 and the control valve 17, and may be configured to be capable of changing a flow path area thereof (that is, a cross-sectional area through which hydraulic oil can flow). Thus, the hydraulic control valve 31 can output a predetermined pilot pressure to a pilot line 25B on the secondary side by using the hydraulic oil of the pilot pump 15 supplied through the pilot line 27B. Therefore, as shown in FIG. 2, the hydraulic control valve 31 can indirectly apply a predetermined pilot pressure corresponding to a control signal from the controller 30 to the control valve 17 through the shuttle valve 32 between the pilot lines 27B and 27. As shown in FIG. 3, the hydraulic control valve 31 can directly apply a predetermined pilot pressure corresponding to the control signal from the controller 30 to the control valve 17 through the pilot line 27B and the pilot line 27. Therefore, the controller 30 can cause the hydraulic control valve 31 to supply the control valve 17 with the pilot pressure corresponding to the operation content of the electric operating device 26, thereby realizing the operation of the shovel 100 based on the operation by the operator.

Further, the controller 30 may control, for example, the hydraulic control valve 31 to realize an automatic operation function. Specifically, the controller 30 outputs a control signal corresponding to an operation command related to the automatic operation function to the hydraulic control valve 31 regardless of whether the operating device 26 is operated. As a result, the controller 30 causes the hydraulic control valve 31 to supply the pilot pressure corresponding to the operation command related to the automatic operation function to the control valve 17, and can realize the operation of the shovel 100 based on the automatic operation function.

In addition, the controller 30 may control, for example, the hydraulic control valve 31 to realize remote operation of the shovel 100. Specifically, the controller 30 outputs a control signal corresponding to the content of the remote operation designated by the remote operation signal received by the communication device 60 from the management device 200 to the hydraulic control valve 31. As a result, the controller 30 causes the hydraulic control valve 31 to supply the pilot pressure corresponding to the content of the remote operation to the control valve 17, and can realize the operation of the shovel 100 based on the remote operation by the operator.

As shown in FIG. 2, the shuttle valve 32 has two inlet ports and one outlet port, and causes the hydraulic oil having the higher pilot pressure of the pilot pressures input to the two inlet ports to be output to the outlet port. The shuttle valve 32 is provided for each driven element (hydraulic actuator) to be operated by the operating device 26. That is, the shuttle valves 32 are provided, for example, for each of the left crawler (traveling hydraulic motor 1ML), the right crawler (traveling hydraulic motor 1MR), the upper pivot body 3 (pivot hydraulic motor 2A), the boom 4 (boom cylinder 7), the arm 5 (arm cylinder 8), and the bucket 6 (bucket cylinder 9). One of the two inlet ports of the shuttle valves 32 is connected to the pilot line 27A on the secondary side of the operating device 26 (specifically, the above-described lever device or pedal device included in the operating device 26), and the other is connected to the pilot line 27B on the secondary side of the hydraulic control valve 31. The outlet port of the shuttle valve 32 is connected to a pilot port of a corresponding control valve of the control valve 17 through the pilot line 27. The corresponding control valve is a control valve for driving a hydraulic actuator which is an operation target of the lever device or the pedal device connected to the one inlet port of the shuttle valve 32. Therefore, each of the shuttle valves 32 can apply the higher one of the pilot pressure of the pilot line 27A on the secondary side of the operating device 26 and the pilot pressure of the pilot line 27B on the secondary side of the hydraulic control valve 31 to the pilot port of the corresponding control valve. That is, the controller 30 causes the hydraulic pressure control valve 31 to output a pilot pressure higher than the pilot pressure on the secondary side of the operating device 26, so that the corresponding control valve can be controlled regardless of the operation of the operating device 26 by the operator. Therefore, the controller 30 can control the operation of the driven elements (the lower traveling body 1, the upper pivot body 3, and the attachment AT), to realize the automatic operation function regardless of the operation state of the operator with respect to the operating device 26.

As shown in FIG. 2, the hydraulic control valve 33 is provided in the pilot line 27A connecting the operating device 26 and the shuttle valves 32. The hydraulic control valve 33 is configured to be capable of changing a flow path area thereof. The hydraulic control valve 33 operates in response to a control signal input from the controller 30. Thus, when the operating device 26 is operated by the operator, the controller 30 can forcibly reduce the pilot pressure output from the operating device 26. Therefore, even when the operating device 26 is operated, the controller 30 can forcibly suppress or stop the operation of the hydraulic actuator corresponding to the operation of the operating device 26. Further, for example, even when the operating device 26 is operated, the controller 30 can reduce the pilot pressure output from the operating device 26 to be lower than the pilot pressure output from the hydraulic control valve 31. Therefore, by controlling the hydraulic control valve 31 and the hydraulic control valve 33, the controller 30 can reliably apply a desired pilot pressure to the pilot port of the control valve in the control valve 17, regardless of the operation content of the operating device 26, for example. Thus, for example, the controller 30 can more appropriately realize the automatic operation function and the remote operation function of the shovel 100 by controlling the hydraulic control valve 33 in addition to the hydraulic control valve 31.

<<User Interface System>>

As shown in FIGS. 2 and 3, the user interface system of the shovel 100 according to the present embodiment includes an operating device 26, an output device 50, and an input device 52.

The output device 50 outputs various types of information to the user (operator) of the shovel 100 inside the cabin 10. The output device 50 includes a display device 50A and a sound output device 50B.

The display device 50A is provided at a position easily visible to the operator seated in the cabin 10, and displays various information images. The display device 50A is, for example, a liquid-crystal display or an organic electroluminescence (EL) display.

The sound output device 50B outputs various types of information by an auditory method, that is, by sound. The sound output device includes, for example, a buzzer and a speaker.

In addition to the display device 50A, the output device 50 may include an indoor lighting device or the like as another device that outputs information by a visual method. The lighting device is, for example, a warning lamp.

In addition, for example, the output device 50 may include a device that outputs various types of information by a tactile method such as vibration of the cockpit.

The input device 52 (an example of an input unit) is provided in a range close to the operator seated in the cabin 10, receives various inputs from the operator, and a signal corresponding to the received input is taken into the controller 30.

For example, the input device 52 is an operation input device that receives an operation input. The operation input device may include a touch panel mounted on the display device, a touch pad provided around the display device, a button switch, a lever, a toggle, a knob switch provided on the operating device 26 (lever device), and the like.

In addition, for example, the input device 52 may be a voice input device that receives voice input of the operator. The voice input device includes, for example, a microphone.

In addition, for example, the input device 52 may be a gesture input device that receives a gesture input of the operator. The gesture input device includes, for example, an imaging device (indoor camera) installed in the cabin 10.

<<Communication System>>

As shown in FIGS. 2 and 3, the communication system of the shovel 100 according to the present embodiment includes a communication device 60.

The communication device 60 is connected to the communication line NW and communicates with a device (for example, the management device 200 or the terminal device 300) provided separately from the shovel 100. The device provided separately from the shovel 100 may include a portable terminal device brought into the cabin 10 by the user of the shovel 100, in addition to the device provided outside the shovel 100. The communication device 60 may include, for example, a mobile communication module conforming to the standard such as 4G (4th Generation) or 5G (5th Generation). The communication device 60 may include, for example, a satellite communication module. The communication device 60 may include, for example, a WiFi communication module, or a Bluetooth (registered trademark) communication module. In addition, the communication device 60 may include, for example, a communication module capable of performing wired communication with a terminal device or the like connected through a cable connected to a predetermined connector.

<<Control System>>

As shown in FIGS. 2 and 3, the control system of the shovel 100 according to the present embodiment includes the controller 30. The control system of the shovel 100 according to the present embodiment includes a boom angle sensor S1, an arm angle sensor S2, a bucket angle sensor S3, a machine body posture sensor S4, a turning angle sensor S5, and an imaging device S6. As shown in FIG. 2, the control system of the shovel 100 according to the present embodiment includes an operation pressure sensor 29 when the operating device 26 is a hydraulic pilot type.

The controller 30 performs various types of control related to the shovel 100. The functions of the controller 30 may be realized by any hardware, an any combination of hardware and software, or the like. For example, the controller is mainly configured by a computer including a central processing unit (CPU), a memory device such as a random access memory (RAM), a non-volatile auxiliary storage device such as a read only memory (ROM), and interface devices for various input and output. For example, the controller 30 realizes various functions by loading a program installed in the auxiliary storage device into the memory device and executing the program by the CPU.

The controller 30 performs control related to operation of the hydraulic actuator (driven element) of the shovel 100, for example, with the hydraulic control valve 31 as a control target.

Specifically, the controller 30 may perform control related to the operation of the hydraulic actuator (driven element) of the shovel 100 based on the operation of the operating device 26 with the hydraulic control valve 31 as a control target.

In addition, the controller 30 may perform control related to the remote operation of the hydraulic actuator (driven element) of the shovel 100 with the hydraulic control valve 31 as a control target. That is, the operation of the hydraulic actuator (driven element) of the shovel 100 may include the remote operation of the hydraulic actuator from the outside of the shovel 100.

In addition, the controller 30 may perform control related to the automatic operation function of the shovel 100 with the hydraulic control valve 31 as a control target. That is, the operation of the hydraulic actuator of the shovel 100 may include an operation command of the hydraulic actuator of the shovel 100 output based on the automatic operation function.

In addition, the controller 30 performs control for providing a work support image to the operator of the shovel 100 through the display device 50A. The controller 30 includes a distribution request unit 301, a storage unit 302, and a display processing unit 303 as functional units for providing the work support image to the operator. The functions of the distribution request unit 301 and the display processing unit 303 are realized by, for example, loading a program installed in the auxiliary storage device into the memory device and executing the program by the CPU. The function of the storage unit 302 is realized by, for example, a storage area defined in an internal memory of the memory device or the auxiliary storage device.

A part of the functions of the controller 30 may be realized by another controller (control device). That is, the functions of the controller 30 may be realized by a plurality of controllers in a distributed manner.

As shown in FIG. 2, the operation pressure sensor 29 detects the pilot pressure on the secondary side (pilot line 27A) of the hydraulic pilot type operating device 26, that is, a pilot pressure corresponding to the operation state of each of the driven elements (hydraulic actuators) in the operating device 26. A detection signal of the pilot pressure corresponding to the operation state of the lower traveling body 1, the upper pivot body 3, the boom 4, the arm 5, the bucket 6, and the like in the operating device 26 by the operation pressure sensor 29 is taken into the controller 30.

The boom angle sensor S1 acquires detection information related to a posture angle of the boom 4 (hereinafter referred to as a "boom angle") with respect to a predetermined reference (for example, a horizontal plane, a state of any one of both ends of a movable angle range of the boom 4, or the like). The boom angle sensor S1 may include, for example, a rotary encoder, an accelerometer, an angular velocity sensor, a six-axis sensor, or an inertial measurement unit (IMU). Further, the boom angle sensor S1 may include a cylinder sensor capable of detecting an extended/retracted position of the boom cylinder 7.

The arm angle sensor S2 acquires detection information related to a posture angle of the arm 5 (hereinafter referred to as an "arm angle") with respect to a predetermined reference (for example, a straight line connecting connection points at both ends of the boom 4, a state of any one of both ends of a movable angle range of the arm 5, or the like). The arm angle sensor S2 may include, for example, a rotary encoder, an accelerometer, an angular velocity sensor, a six-axis sensor, or an IMU. Further, the arm angle sensor S2 may include a cylinder sensor capable of detecting an extended/retracted position of the arm cylinder 8.

The bucket angle sensor S3 acquires detection information related to a posture angle of the bucket 6 (hereinafter referred to as a "bucket angle") with respect to a predetermined reference (for example, a straight line connecting connection points at both ends of the arm 5, a state of any one of both ends of a movable angle range of the bucket 6, or the like). The bucket angle sensor S3 may include, for example, a rotary encoder, an accelerometer, an angular velocity sensor, a six-axis sensor, or an IMU. Further, the bucket angle sensor S3 may include a cylinder sensor capable of detecting an extended/retracted position of the bucket cylinder 9.

The machine body posture sensor S4 acquires detection information related to a posture state of the machine body including the lower traveling body 1 and the upper pivot body 3. The posture state of the machine body includes an inclination state of the machine body. The inclination state of the machine body includes, for example, an inclination state in the front-rear direction corresponding to a posture state around the left-right axis of the upper pivot body 3, and an inclination state in the left-right direction corresponding to a posture state around the front-rear axis of the upper pivot body 3. The posture state of the machine body includes a turning state of the upper pivot body 3 corresponding to a posture state around the pivot axis of the upper pivot body 3. The machine body posture sensor S4 is mounted on, for example, the upper pivot body 3, and acquires (outputs) detection information regarding posture angles (hereinafter referred to as "front-rear inclination angle" and "left-right inclination angle") about the front-rear axis, the left-right axis, and the pivot axis of the upper pivot body 3. As a result, the machine body posture sensor S4 can acquire detection information regarding the orientation of the upper pivot body 3 with respect to the ground (turning posture about the pivot axis). The orientation of the upper pivot body 3 means, for example, a direction in which the attachment AT extends in a top view, that is, a front side viewed from the upper pivot body 3. The machine body posture sensor S4 may include, for example, an accelerometer (inclination sensor), an angular velocity sensor, a six-axis sensor, or an IMU.

Note that the information regarding the orientation of the upper pivot body 3 with respect to the ground may be acquired from another device instead of or in addition to the machine body posture sensor S4. For example, a geomagnetic sensor (first acquisition device) may be mounted on the upper pivot body 3. In this case, the controller 30 can acquire information on the orientation of the upper pivot body 3 with respect to the ground from the geomagnetic sensor. In addition, for example, the controller 30 may determine the orientation of the upper pivot body 3 with respect to the ground by determining the direction in which a surrounding object (in particular, a fixed object such as a utility pole or a tree) is present on the basis of the outputs (captured images) of the imaging device S6. That is, the information on the orientation of the upper pivot body 3 with respect to the ground may be acquired from the imaging device S6.

The turning angle sensor S5 acquires detection information on a relative turning angle of the upper pivot body 3 with respect to the lower traveling body 1. As a result, the turning angle sensor S5 acquires the detection information regarding the turning angle of the upper pivot body 3 with respect to, for example, a predetermined reference (for example, a state in which the forward movement direction of the lower swing body 1 coincides with the front direction of the upper pivot body 3). The turning angle sensor S5 includes, for example, a potentiometer, a rotary encoder, or a resolver.

The information on the orientation of the upper pivot body 3 with respect to the lower traveling body 1 may be acquired from another device instead of or in addition to the turning angle sensor S5. For example, a geomagnetic sensor may be mounted on each of the lower traveling body 1 and the upper pivot body 3. In this case, the controller 30 can acquire information on the orientation of the upper pivot body 3 with respect to the lower traveling body 1 based on the output of the geomagnetic sensor of the lower traveling body 1 and the output of the geomagnetic sensor of the upper pivot body 3. In addition, for example, the controller 30 may determine the orientation of the upper pivot body 3 with respect to the lower traveling body 1 from the position of the lower traveling body 1 in the imaging device or the like by using the outputs (captured images) of the imaging device S6. That is, the information on the orientation of the upper pivot body 3 with respect to the lower traveling body 1 may be acquired from the imaging device S6. In addition, the orientation of the upper pivot body 3 with respect to the ground and the orientation of the upper pivot body 3 with respect to the lower traveling body 1 may be simply assumed to be substantially the same. In this case, the turning angle sensor S5 may be omitted.

For example, the shovel 100 may be further equipped with a positioning device capable of measuring the absolute position of the shovel 100. The positioning device is, for example, a global navigation satellite system (GNSS) sensor. Accordingly, it is possible to improve the estimation accuracy of the posture state of the shovel 100.

The imaging device S6 images the periphery of the shovel 100 and outputs a captured image. The captured image output from the imaging device S6 is captured by the controller 30.

The imaging device S6 includes, for example, a monocular camera, a stereo camera, or a depth camera. In addition, the imaging device S6 may acquire three-dimensional data (for example, point group data or surface data) representing a position and an outer shape of an object around the shovel 100 within a predetermined imaging range (angle of view) based on the captured image.

Instead of or in addition to the imaging device S6, for example, a distance sensor, such as a light detecting and ranging (LiDAR) device, a millimeter wave radar, an ultrasonic sensor, an infrared sensor, or a distance image sensor, may be mounted on the shovel 100. The distance sensor may acquire three-dimensional data (for example, point group data) representing a position and a shape of an object around the shovel 100 within a predetermined detection range.

As shown in FIG. 1, the imaging device S6 is attached to, for example, a front end of an upper surface of the cabin 10, and acquires a captured image of a front side of the upper pivot body 3 including a work range of the end attachment (bucket 6). Thus, the controller 30 can recognize the situation in front of the shovel 100 based on the output of the imaging device S6. In addition, the controller 30 can recognize the position of the shovel 100, the turning state of the upper pivot body 3, and the like based on a change in the position, the appearance, and the like of an object around the shovel 100 recognized from the outputs (captured images) of the imaging device S6. The imaging range of the imaging device S6 includes the boom 4, the arm 5, and the end attachment (bucket 6), that is, the attachments. Accordingly, the controller 30 can recognize the posture state of the attachment (for example, the posture angle of at least one of the boom 4, the arm 5, and the bucket 6) based on the output of the imaging device S6. Therefore, when the shovel 100 is remotely operated, the controller 30 can transmit the surrounding image based on the imaging device S6 and the information regarding the recognition result to the management device 200 and the terminal device 300, and can provide an external operator with information regarding the situation of the shovel 100 (reference machine) and the surrounding thereof. When the shovel 100 operates in the complete automatic operation function, a control device (for example, the controller 30) related to the complete automatic operation function can output an operation command related to the hydraulic actuator while grasping a situation around the shovel 100, a posture state of the shovel 100, and the like. Further, when the shovel 100 operates with the complete automatic operation function, the controller 30 can transmit the surrounding image based on the imaging device S6 and the information on the recognition result to the management device 200 and the terminal device 300, and provide information on the situation of the shovel 100 (reference machine) and the periphery thereof to the user (supervisor) who externally monitors the work.

In addition, the imaging device S6 may be further configured to be able to acquire a captured image related to at least one of the left side, the right side, and the rear side of the upper pivot body 3. To be specific, the imaging device S6 may include at least one of a camera capable of imaging the left side of the upper pivot body 3, a camera capable of imaging the right side of the upper pivot body 3, and a camera capable of imaging the rear side of the upper pivot body 3, in addition to the camera capable of imaging the front side of the upper pivot body 3. Thus, the controller 30 can recognize not only the situation in front of the shovel 100 (upper pivot body 3) but also the situation on the left, right, or rear of the shovel 100 (upper pivot body 3).

The distribution request unit 301 (an example of a request unit) transmits a distribution request for a work support image to the management device 200 through the communication device 60.

Figure 16:
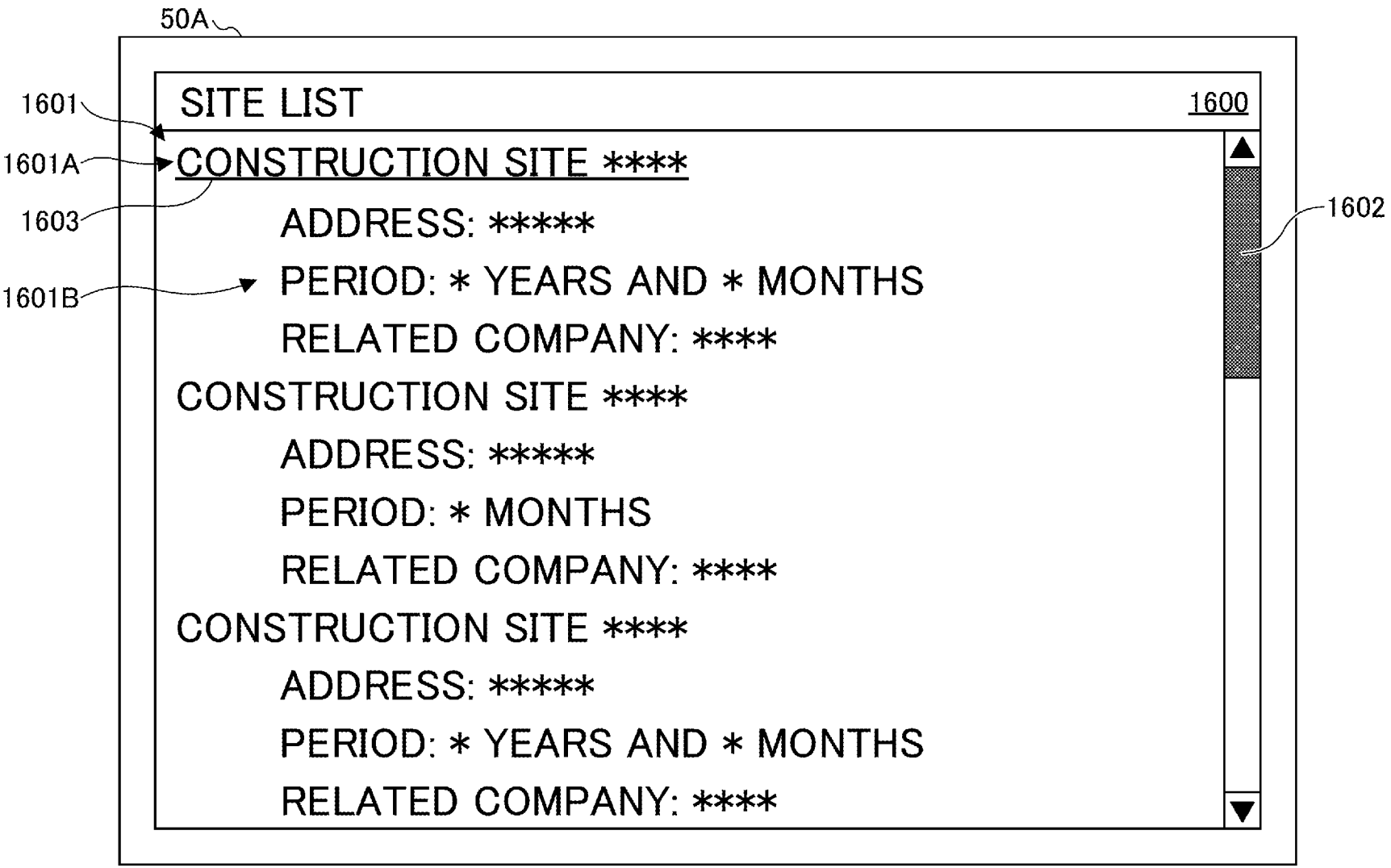
FIG. 16 is a diagram showing a first example of an application screen for searching for a desired work support image.
Figure 17:
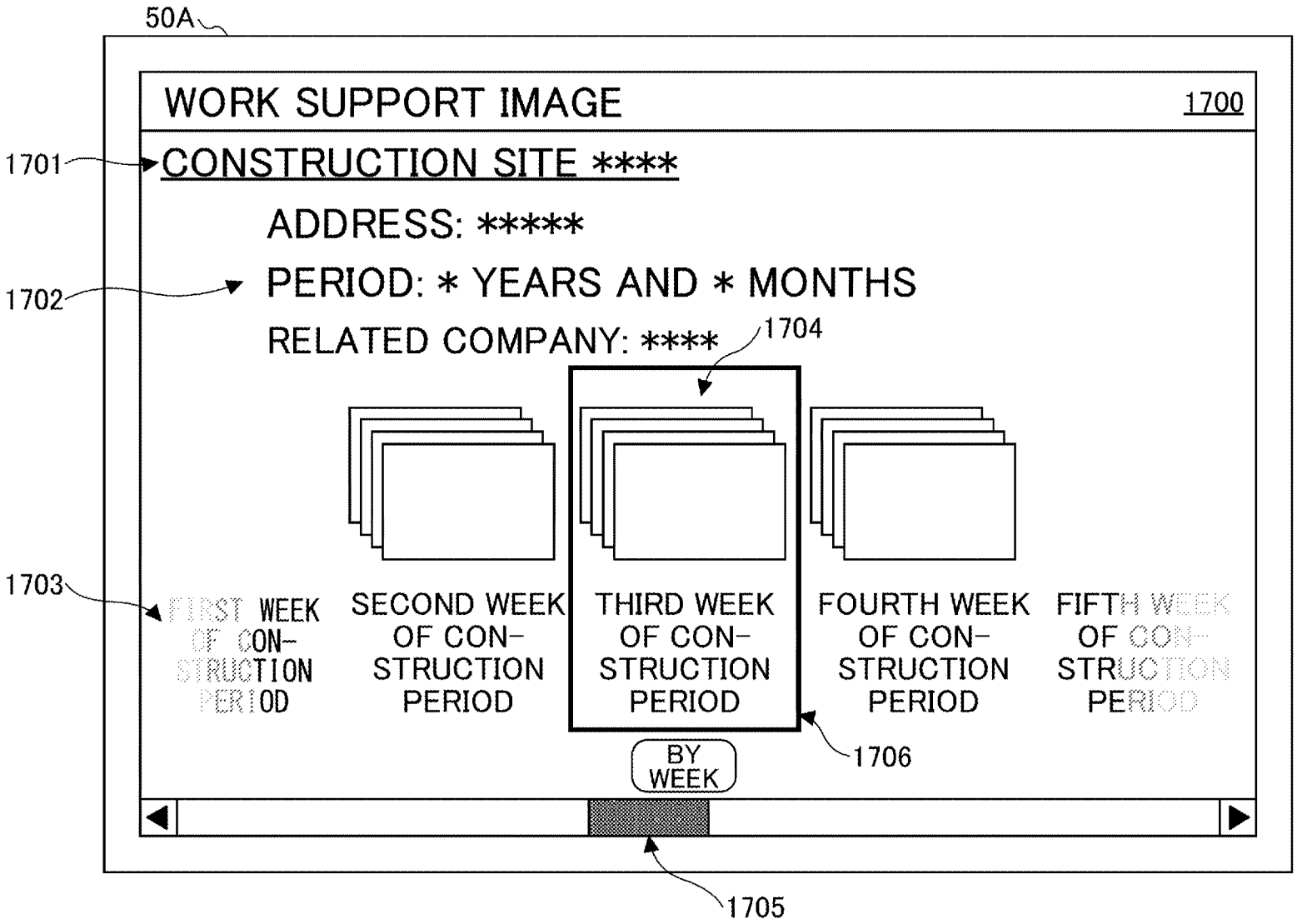
FIG. 17 is a diagram showing a second example of the application screen for searching for a desired work support image.
Figure 18:
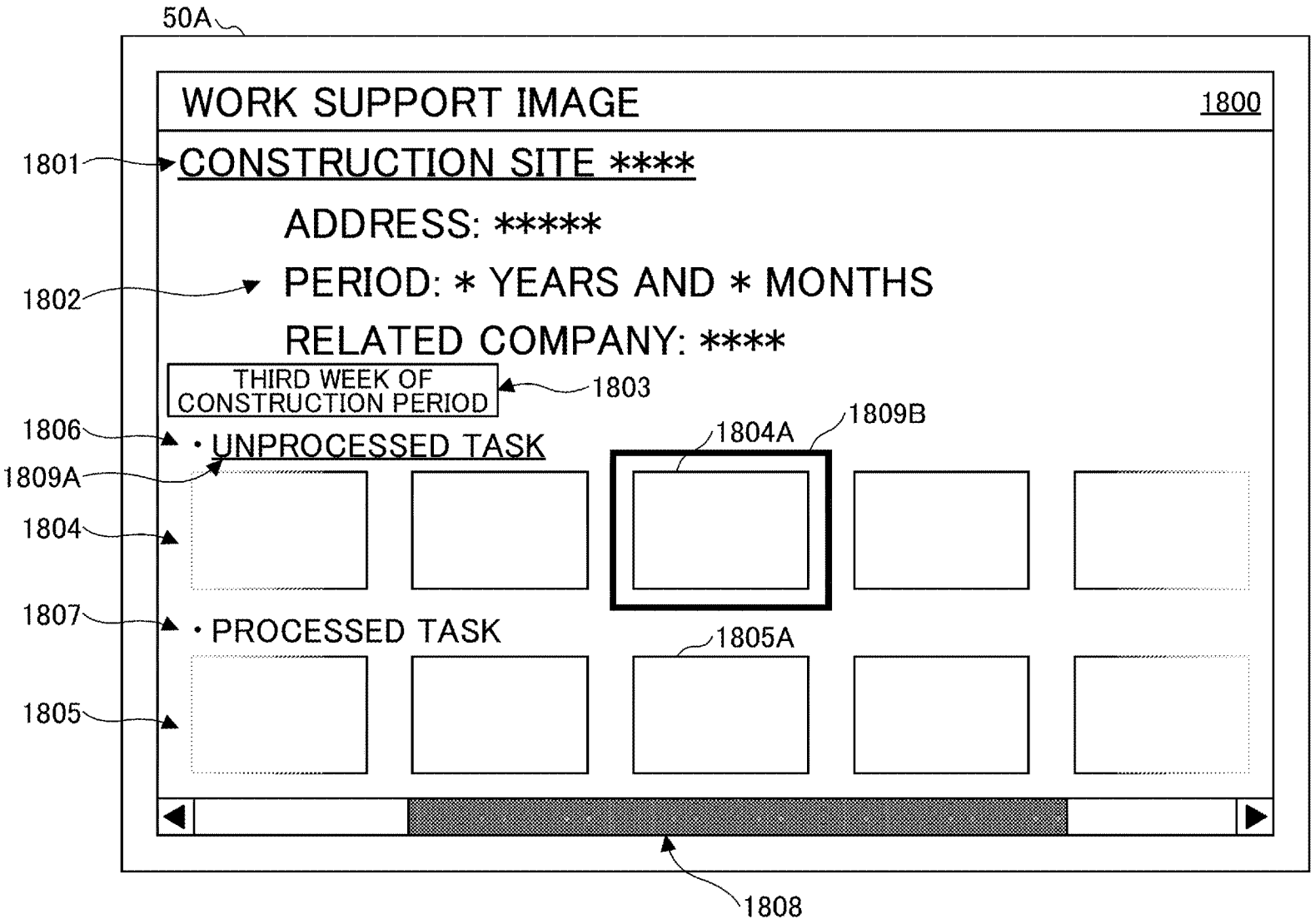
FIG. 18 is a diagram showing a third example of the application screen for searching for a desired work support image.

For example, distribution request unit 301 transmits a distribution request for a work support image to management device 200 in response to a predetermined input operation of the operator received through input device 52 (refer to FIGS. 16 to 18).

Specifically, the operator may perform a predetermined input from the input device 52 to cause the controller 30 to activate an application program (hereinafter, referred to as a "work support application") for displaying a work support image installed in the auxiliary storage device of the controller 30. Then, the operator may perform a predetermined operation using the input device 52 on a screen of the work support application (hereinafter, referred to as an "application screen") to request display of a work support image for the most recent work (for example, work on the present day or the next day) of the shovel 100. The operator may designate a specific work day or the like on the application screen through the input device 52. Accordingly, the distribution request unit 301 can transmit a distribution request including date and time information of the current time or a specific work day and identification information of the shovel 100 (hereinafter, referred to as "shovel identification information") to the management device 200 in response to an input from the operator through the input device 52. The shovel identification information is an identifier (ID), a machine body serial number, or the like, unique to each shovel 100. Therefore, the distribution request unit 301 can cause the management device 200 to distribute the work of the shovel 100 to be distributed from the management device to the shovel 100. In the following description, it is assumed that the same work support application has already been installed in the management device 200 and the terminal device 300.

In addition, for example, the distribution request unit 301 automatically transmits a distribution request of the work support image to the management device 200.

Specifically, the distribution request unit 301 transmits a distribution request for a work support image to the management device 200 at a predetermined timing.

For example, the predetermined timing may be the stop time (end processing time) of the shovel 100 accompanying the end of the work on the next day or the day on which the work is scheduled to be performed after a predetermined number of days. At this time, the operation information of the shovel 100 including the work schedule of the current day and the work schedule of the next day of the shovel 100 may have been appropriately distributed from the management device 200 to the shovel 100, for example. Accordingly, the distribution request unit 301 can grasp the end timing of the work on the current day and transmit the work support image related to the work on the next day or after a predetermined number of days to the management device 200 through the communication device 220 to the management device 200.

In addition, for example, the predetermined timing may be a predetermined time every day. In this case, when the management device 200 that receives the distribution request confirms the schedule of the work of the target shovel 100 and the work of the shovel 100 is scheduled the next day or after a predetermined number of days has elapsed, the work support image may be distributed to the shovel 100.

Further, for example, the predetermined timing may be manually set by a predetermined input received from the operator through the input device 52 on the application screen.

Further, the work support image may be automatically distributed from the management device 200 to the shovel 100 regardless of the distribution request from the distribution request unit 301.

The storage unit 302 stores the work support image received from the management device 200 through the communication device 60. The storage unit 302 may store a work support image that has been received (downloaded) in advance before a timing at which the work support image is viewed through the display device 50A. In addition, the storage unit 302 may be configured to temporarily store (a part of) the work support image received in real time in accordance with the timing at which the work support image is viewed through the display device 50A.

The display processing unit 303 displays the work support image received from the management device 200 through the communication device 60 on the display device 50A (application screen). Accordingly, the operator can view the work support image displayed on the application screen and confirm various types of information for supporting the work by the shovel 100 in advance. Therefore, the operator can smoothly proceed with the work by the shovel 100, and the controller 30 can improve the work efficiency of the shovel 100. Details of the work support image displayed on the display device 50A will be described later (see FIGS. 4 to 15).

<Configuration of Management Device>

As illustrated in FIGS. 2 and 3, the management device 200 includes a control device 210, a communication device 220, an input device 230, and an output device 240.

The control device 210 performs various types of control related to the management device 200. The function of the control device 210 is realized by any hardware, a combination of any hardware and software, or the like. The control device 210 is mainly configured by a computer including, for example, a CPU, a memory device such as a RAM, a nonvolatile auxiliary storage device such as a ROM, and an interface device for various inputs and outputs. For example, the control device 210 realizes various functions by executing a program installed in the auxiliary storage device by the CPU. The program is loaded into the control device 210 from a recording medium connected through the interface device, for example. The recording medium is, for example, a disk medium such as a CD (Compact Disc) or a DVD (Digital Versatile Disc), or a memory card such as an SD card. Alternatively, the program may be downloaded from an external computer via the communication device 220 and installed in the auxiliary storage device.

For example, the control device 210 performs processing of acquiring information received from the shovel 100 by the communication device 220, constructing a database, and performing predetermined processing to generate processing information.

Further, for example, the control device 210 performs control for supporting remote operation of the shovel 100. The control device 210 may capture a signal of an input related to the remote operation of the shovel 100 received by the remote operating device, and transmit a remote operation signal representing the content of the operation input, that is, the content of the remote operation of the shovel 100 to the shovel 100 using the communication device 220.

For example, the control device 210 performs control for providing a work support image to an operator, a supervisor, or the like of the shovel 100 through the shovel 100, the output device 240, or the terminal device 300. The control device 210 includes a work support image generation unit 2101, a storage unit 2102, a work support image distribution unit 2103, and a display processing unit 2104 as functional units for providing a work support image to an operator, a supervisor, or the like of the shovel 100. The functions of the work support image generation unit 2101, the work support image distribution unit 2103, and the display processing unit 2104 are realized by, for example, loading a program installed in the auxiliary storage device into the memory device and executing the program by the CPU. The function of the storage unit 2102 is realized by, for example, a storage area defined in the auxiliary storage device.

The communication device 220 is connected to the communication line NW and communicates with the outside of the management device 200 (for example, the shovel 100).

The input device 230 (an example of an input unit) receives an input from the manager, the operator, or the like of the management device 200, and outputs a signal representing the content of the input (for example, an operation input, a voice input, a gesture input, or the like). The signal representing the content of the input is taken into the control device 210.

The input device 230 may include, for example, a remote operating device. Accordingly, the worker (operator) of the management device 200 can remotely operate the shovel 100 using the remote operating device.

The output device 240 outputs various types of information to the user of the management device 200.

The output device 240 (an example of a display unit) includes, for example, a lighting device or a display device that outputs various types of information to the user of the management device 200 by a visual method. The lighting device includes, for example, a warning lamp or the like. The display device includes, for example, a liquid crystal display and an organic EL display. In addition, the output device 240 includes a sound output device that outputs various types of information to the user of the management device 200 by an auditory method. The sound output device includes, for example, a buzzer and a speaker.

The display device displays various information images related to the management system SYS (the shovel 100, the management device 200, and the terminal device 300). The display device may include, for example, a remote operation display device or a monitoring display device, and the remote operation display device or the monitoring display device may display image information (peripheral image) of the periphery of the shovel 100 uploaded from the shovel 100 under the control of the control device 210. As a result, the user (operator) of the management device 200 can remotely operate the shovel 100 while checking the image information around the shovel 100 displayed on the remote operation display device. In addition, the user (supervisor) of the management device 200 can monitor the work situation of the shovel 100 while checking the image information of the periphery of the complete automatic shovel 100 displayed on the monitoring display device.

The work support image generation unit 2101 (an example of a generation unit) generates a work support image to be provided to the operator or the supervisor of the shovel 100.

For example, the work support image generation unit 2101 generates a work support image in response to an input from the user of the management device 200 through the input device 230. Specifically, the user of the management device 200 may operate software corresponding to the work support image generation unit 2101 through the input device 230 to generate a work support image while receiving advice (supervision) from a skilled operator.

In addition, for example, the work support image generation unit 2101 automatically generates the work support image. Specifically, based on the content of the planned work of the shovel 100 and the database of the work results, information regarding the setup of a recommended work is generated. The setup of the work includes not only information on the order of the plurality of processes whose order can be changed but also information on advance preparation in another process for one process among the plurality of processes whose order is determined in advance. More specifically, the work support image generation unit 2101 may perform reinforcement learning to maximize a reward related to work efficiency or the like by extracting work result data that match a condition related to the content of a scheduled work of the shovel 100 and searching the extracted work result data group. In addition, the work support image generation unit 2101 may perform reinforcement learning based on a simulation result of a simulator capable of simulating the work of the shovel 100 on a computer instead of or in addition to the work result database. In this way, the work support image generation unit 2101 can generate the information regarding the setup of the work indicating the content of the work such that the reward is maximized. Therefore, while appropriately extracting and using image information from a basic image information group prepared in advance, the work support image generation unit 2101 can automatically generate a work support image such as a slide show by a moving image or a still image group for explaining information related to a setup of work. In addition, the work support image generation unit 2101 may automatically generate only the information related to the setup of the recommended work. In this case, the user of the management device 200 may operate the software corresponding to the work support image generation unit 2101 through the input device 230 to generate the work support image while checking the automatically generated information on the setup of the work.

The storage unit 2102 (an example of a first storage unit and a second storage unit) stores the work support image generated by the work support image generation unit 2101. Specifically, in the storage unit 2102, the work support image is stored, and a work support image database configured to be linked to the work support image is constructed. The work support image database is configured by, for example, a record data group including information on a construction site, information on a time, identification information of a work support image, link information, and address information of a storage area. The identification information is, for example, an identification (ID). The information related to the construction site is information representing a work site where the work corresponding to the target work support image is performed. The information related to the time is information indicating a time when the work corresponding to the target work support image is performed. The timing information is, for example, information representing a date on which the work corresponding to the target work support image is performed. The timing information may be information indicating a timing at which the work corresponding to the target work support image is performed in the entire period at the construction site. Accordingly, the control device 210 can extract the work support image in accordance with the time of the work designated by the user through the input device 52,230,330 and provide the work support image to the user (refer to FIGS. 16 to 18). The control device 210 may extract the work support image based on the user identification information or the shovel identification information designated by the user using the work support database and the information related to the work schedule of the user or the shovel 100. The information related to the work schedule of the user or the shovel 100 is registered in the storage unit 2102 or another storage area of the management device 200 by, for example, the manager or the operator of the management device 200. The shovel identification information is information for identifying the shovel 100 that performs the work corresponding to the target work support image. The user identification information is information for identifying a user in charge of the work corresponding to the target work support image. Specifically, the control device 210 can grasp the work schedule of the user or the shovel 100, extract a work support image in accordance with a construction site or a work day of the most recent work schedule of the user or the shovel 100, and provide the work support image to the user. The record data may also include user identification information and shovel identification information. Accordingly, the control device 210 can directly extract a desired work support image based on the user identification information, the shovel identification information, and the time information when the work is performed, and provide the work support image to the user.

The work support image database may be registered in a storage area (an example of a second storage unit) different from the storage unit 2102 in the management device 200.

The work support image distribution unit 2103 (an example of a transmission unit) distributes the work support image to the shovel 100 and the terminal device 300 through the communication device 220.

For example, when a distribution request is received from the shovel 100 or the terminal device 300 through the communication device 220, the work support image distribution unit 2103 may extract a work support image matching the date information and the shovel identification information included in the distribution request from the storage unit 2102. Then, the work support image distribution unit 2103 may transmit the extracted work support image to the shovel 100 or the terminal device 300 that is the transmission source of the distribution request through the communication device 220.

For example, the work support image distribution unit 2103 automatically transmits the work support image to the shovel 100 or the terminal device 300. Specifically, at a predetermined time on the day before or several days before the work day of the shovel 100, the work support image matching the date and time information corresponding to the work day and the shovel identification information corresponding to the target shovel 100 may be extracted from the storage unit 2102. Then, the work support image distribution unit 2103 may transmit the extracted work support image to the target shovel 100 or the terminal device 300 registered in association with the target shovel 100. For example, a record group in which the identification information of the terminal device 300 (hereinafter, "terminal identification information") and the shovel identification information are associated with each other may be registered in the auxiliary storage device. Accordingly, the work support image distribution unit 2103 can specify the target shovel 100 based on the terminal identification information included in the distribution request from the terminal device 300.

The display processing unit 2104 causes the output device 240 (display device) to display the work support image in response to a predetermined input received from the user (operator or supervisor) of the management device 200 on the application screen through the input device 230. Accordingly, the operator who remotely operates the shovel 100 can smoothly proceed with the work by the shovel 100, and the control device 210 can improve the work efficiency of the shovel 100. In addition, the supervisor of the complete automatic shovel 100 can grasp the point of the work by checking the work support image and smoothly monitor the work of the shovel 100 in accordance with the point of the work.

In the predetermined input, the work day (date and time information) of the shovel 100 and the target shovel 100 (shovel identification information) are designated. As a result, the display processing unit 2104 can extract the work support image matching the work day and the shovel 100 designated by the user from the storage unit 2102 and cause the output device 240 (display device) to display the work support image.

<Configuration of Terminal Device>

As shown in FIGS. 2 and 3, the terminal device 300 includes a control device 310, a communication device 320, an input device 330, and an output device 340.

The control device 310 performs various types of control related to the terminal device 300. The function of the control device 310 is realized by any hardware, a combination of any hardware and software, or the like. The control device 310 is mainly configured by a computer including, for example, a CPU, a memory device such as a RAM, a nonvolatile auxiliary storage device such as a ROM, and an interface device for various inputs and outputs. For example, the control device 310 realizes various functions by executing a program installed in the auxiliary storage device by the CPU. The program is loaded into the control device 310 from a recording medium connected through an interface device, for example. The recording medium is, for example, a memory card such as an SD card. In addition, the program may be downloaded from an external computer (for example, the management device 200) through the communication device 320 and installed in the auxiliary storage device.

For example, the control device 310 performs control related to remote operation of the shovel 100. The control device 310 may capture a signal of an input related to the remote operation of the shovel 100 received by the remote operating device, and transmit a remote operation signal representing the content of the operation input, that is, the content of the remote operation of the shovel 100 to the shovel 100 using the communication device 320.

In addition, for example, the control device 310 performs control for requesting information on the shovel 100 from the management device 200 and providing information on the shovel 100 received from the management device 200 to the user of the terminal device 300 through the output device 340.

Specifically, the control device 310 performs control for providing the work support image to the user of the terminal device 300 through the output device 340. The control device 310 includes a distribution request unit 3101 and a display processing unit 3103 as functional units for providing the work support image to the user of the terminal device 300. The functions of the distribution request unit 3101 and the display processing unit 3103 are realized by, for example, loading a program installed in the auxiliary storage device into the memory device and executing the program by the CPU.

The communication device 320 is connected to the communication line NW and communicates with the outside of the terminal device 300 (for example, the shovel 100).

The input device 330 (an example of an input unit) receives an input from the manager, the operator, or the like of the terminal device 300 and outputs a signal representing the content of the input (for example, an operation input, a voice input, or a gesture input). A signal representing the content of the input is taken into the control device 310.

The input device 330 may include, for example, a remote operating device. Accordingly, the worker (operator) of the terminal device 300 can remotely operate the shovel 100 using the remote operating device.

The output device 340 (an example of a display unit) outputs various types of information to the user of the terminal device 300.

The output device 340 includes, for example, an illumination device or a display device that outputs various types of information to the user of the terminal device 300 by a visual method. The lighting device includes, for example, a warning lamp or the like. The display device includes, for example, a liquid crystal display and an organic EL display. In addition, the output device 340 includes a sound output device that outputs various types of information to the user of the terminal device 300 by an auditory method. The sound output device includes, for example, a buzzer and a speaker.

The display device displays various information images related to the management system SYS (the shovel 100, the management device 200, and the terminal device 300). The display device may include, for example, a remote operation display device or a monitoring display device, and the remote operation display device or the monitoring display device may display image information (peripheral image) of the periphery of the shovel 100 uploaded from the shovel 100 under the control of the control device 310. As a result, the user (operator) of the terminal device 300 can remotely operate the shovel 100 while checking the image information around the shovel 100 displayed on the remote operation display device. In addition, the user (supervisor) of the terminal device 300 can monitor the work situation of the shovel 100 while checking the image information of the periphery of the complete automatic shovel 100 displayed on the monitoring display device.

The distribution request unit 3101 (an example of a request unit) transmits a distribution request for a work support image to the management device 200 through the communication device 320.

For example, the distribution request unit 3101 transmits a distribution request for a work support image to the management device 200 in response to a predetermined input of the operator received through the input device 330 (See FIGS. 16 to 18).

Specifically, the user of the terminal device 300 may perform a predetermined input from the input device 330 to activate the work support application. Then, the user may perform a predetermined operation using the input device 330 on the application screen to request display of a work support image such as the most recent work or a specific work day of the target shovel 100 registered in advance in the terminal device 300 and the management device 200. When a plurality of shovels 100 are registered in advance in the terminal device 300, the user may designate a target shovel 100 from among the plurality of shovels 100 by an operation on the application screen. Accordingly, the distribution request unit 3101 can transmit a distribution request including the current or specific date and time information, the terminal identification information, and the shovel identification information of the target shovel 100 in response to an input from the user through the input device 330. Therefore, the distribution request unit 3101 can cause the work support image related to the expected work of the shovel 100 to be distributed from the management device 200 to the terminal device 300. When the number of shovels 100 registered in the terminal device 300 is one, the shovel identification information may be omitted from the distribution request. This is because the terminal identification information and the shovel identification information are registered in association with each other in the management device 200 as described above, and the target shovel 100 can be specified by the management device 200.

In addition, for example, the distribution request unit 3101 automatically transmits a distribution request of the work support image to the management device 200.

Specifically, the distribution request unit 3101 transmits a distribution request for a work support image to the management device 200 at a predetermined timing.

For example, the predetermined timing may be a predetermined time on a daily basis.

Further, for example, the predetermined timing may be manually set by a predetermined input received from the user through the input device 330 on the application screen.

As described above, the work support image may be automatically distributed from the management device 200 to the terminal device 300 without depending on the distribution request from the distribution request unit 3101.

The storage unit 3102 stores the work support image received from the management device 200 through the communication device 320. The storage unit 3102 may store a work support image that has been received (downloaded) in advance before a timing at which the work support image is viewed through the output device 340 (display device). In addition, the storage unit 3102 may temporarily store (a part of) the work support image received in real time through the output device 340 (display device) in accordance with the timing at which the work support image is viewed.

The display processing unit 3103 causes the output device 340 (application screen) to display the work support image received from the management device 200 through the communication device 320. Accordingly, the operator can view the work support image displayed on the application screen and confirm various types of information for supporting the work by the shovel 100 in advance. Therefore, the user (operator) of the terminal device 300 can smoothly proceed with the work by the shovel 100, and the controller 30 can improve the work efficiency of the shovel 100. In addition, the user of the terminal device 300 (the supervisor of the complete automatic shovel 100) can grasp the point of the work by checking the work support image and smoothly monitor the work of the shovel 100 in accordance with the point of the work.

[Specific Example of Work Support Image]

Next, specific examples of the work support image will be described with reference to FIGS. 4 to 15.

In the following description, the work support image displayed on the display device 50A of the shovel 100 will be described as an example. However, it is assumed that the work support image to be described later can also be displayed on the output device 240 (display device) of the management device 200 or the output device 340 (display device) of the terminal device 300.

<First Example of Work Support Image>

Figure 4:
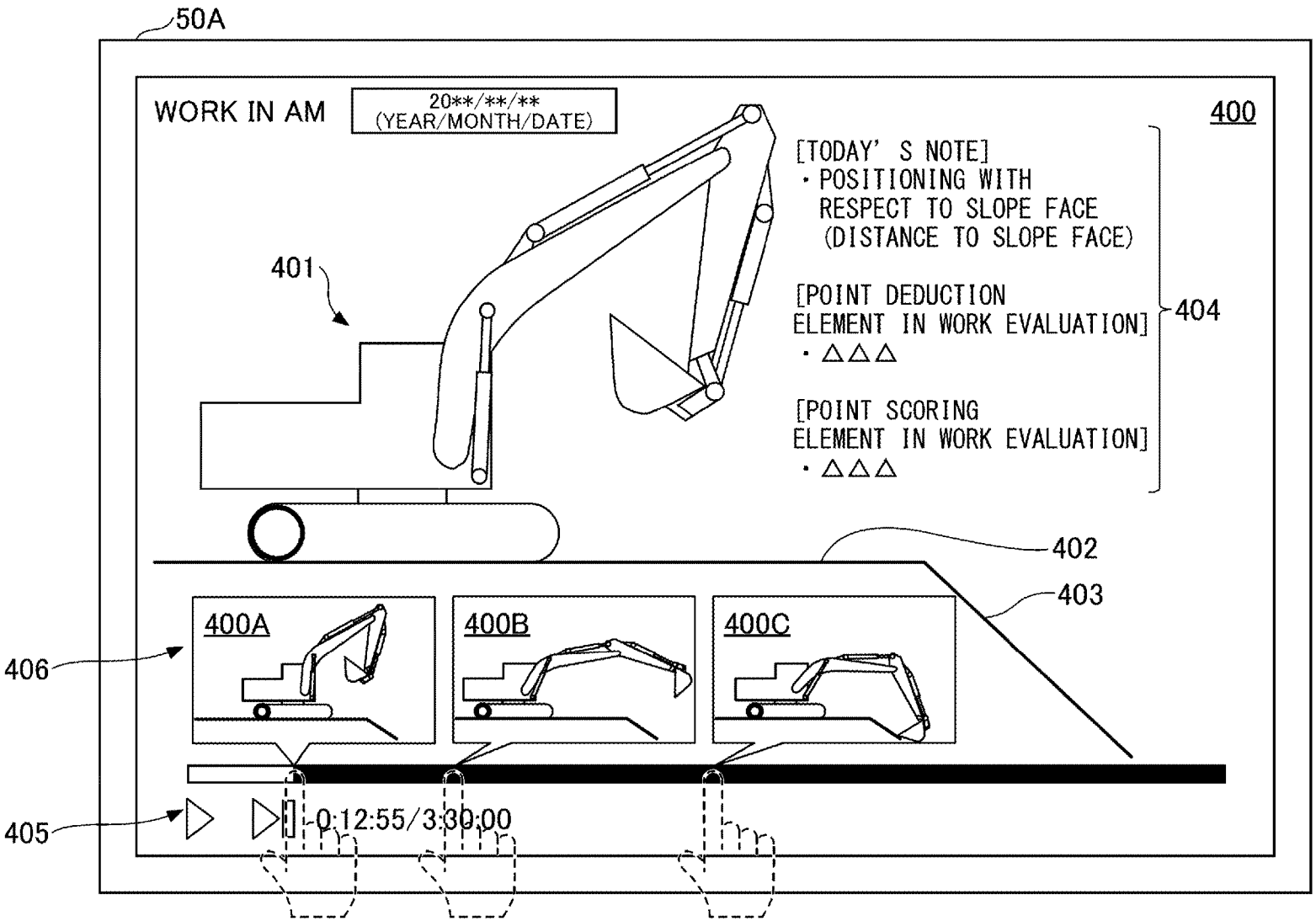
FIG. 4 is a diagram showing a first example of a work support image displayed on a display device.

FIG. 4 is a diagram illustrating a first example of a work support image (work support image 400) displayed on the display device 50A. To be more specific, FIG. 4 is a diagram showing a specific example (work support image 400) of the first work support image displayed on the display device 50A.

As shown in FIG. 4, the work support image 400 is a moving image illustrating the content of the work of the slope construction of the shovel 100 in a side view of the shovel 100. The slope construction includes a cutting-out operation performed in a state where the toe of the bucket 6 is relatively raised with respect to the slope, a leveling operation performed in a state where the toe of the bucket 6 is relatively laid down with respect to the slope, and a rolling operation performed using the back surface of the bucket 6.

The work support image 400 includes a shovel image 401, a work plane image 402, a work target image 403, a work teaching image 404, an operation image 405, and a thumbnail display area 406.

The shovel image 401 is an image simulating the shovel 100.

The work plane image 402 is an image simulating a plane on which the shovel 100 (the lower traveling body 1) is positioned for work.

The work target image 403 is an image indicating a target place on which the shovel 100 performs work using the attachment AT.

In this example, by the shovel image 401, the work plane image 402, and the work target image 403, elements on which the shovel 100 positioned on the work plane (horizontal plane) on the top side of the slope performs the slope face construction work are displayed as moving images on the display device 50A.

The work teaching image 404 is an image indicating information (hereinafter referred to as "teaching information") for teaching the user about the work.

In this example, the work teaching image 404 includes teaching information of "today's notes", "point deduction item of work evaluation", and "point addition item of work evaluation".

In the "today's notes", a point to be noticed in today's work (in this example, slope construction work) is taught. In this example, the positioning of the shovel 100 with respect to the slope, i.e., the distance between the slope and the shovel 100, is given as a note. This is because if the position of the attachment AT with respect to the slope in the preparation step is too far from the slope, there is a possibility that the tip of the attachment AT does not appropriately reach the construction target place on the slope, or even if the tip of the attachment AT reaches the construction target place, the bucket 6 cannot be brought into contact with the construction target place in an appropriate posture. In addition, if the shovel 100 is too close to the slope, the ground at the intersection between the slope and the work plane may collapse due to the influence of the shovel 100, and the shovel 100 may fall to the slope side. Accordingly, the operator or the supervisor of the shovel 100 can understand the point to be watched in the preparation process for the main work process (the slope construction work) even when the operator or the supervisor has little experience with the main work process (the slope construction work). Therefore, the working efficiency and safety of the shovel 100 can be improved.

The "point deduction item of work evaluation" is a point deduction item in the evaluation of the work viewed from an operator, a manager, or the like having a relatively high degree of skill, that is, teaching information representing an undesirable operation mode of the shovel 100. As a result, even when the operator has little experience in the main work process (slope construction work), the operator can recognize an undesirable operation mode of the shovel 100 in the main work process and perform the actual work. Therefore, an undesirable operation mode of the shovel 100 is less likely to be performed, and the work efficiency and safety of the shovel 100 can be improved. In addition, the supervisor of the shovel 100 can monitor the actual work after recognizing the undesirable operation mode of the shovel 100 in the main work process. Therefore, it is possible to monitor the shovel 100 operating with the automatic operation function by paying attention to an undesirable operation mode in the main work process. Therefore, the supervisor can take measures such as an intervention operation and an emergency stop for an undesirable work process of the shovel 100, and the work efficiency and safety of the shovel 100 can be improved.

The "point addition item of the work evaluation" is a point addition item in the evaluation of the work viewed from an operator, a manager, or the like having a relatively high skill level, that is, teaching information representing a more preferable operation mode of the shovel 100. Accordingly, even when the operator has little experience in the main work process (slope construction work), the operator can perform the actual work after recognizing a more preferable operation mode of the shovel 100 in the main work process. For this reason, a more preferable operation mode of the shovel 100 is easily performed, and the work efficiency and safety of the shovel 100 can be improved.

The operation image 405 is arranged below the work support image. The operation image 405 is an image representing an operation target for arbitrarily operating the content of the image changing in a time series of the work support image 400 as a moving image by manually fast-forwarding or rewinding the content. In this example, the operation image 405 includes a seek bar indicating a reproduction position in a time series in the entire work support image 400 as a moving image.

The seek bar is disposed so as to extend between the left end portion and the right end portion in the lower portion of the work support image 400. In the seek bar, the left end portion represents a start point of the moving image, the right end portion represents an end point of the moving image, a portion from the start point (left end portion) to a position representing a current reproduction position is represented in white, and a portion closer to the end point (right side) than the current reproduction position is represented in gray. In this example, the seek bar indicates that a portion of the work support image 400 as a moving image of 3 minutes and 30 seconds in total, which is 12 seconds 55 ahead of the start point, is reproduced, that is, displayed on the display device 50A.

In addition, by designating any position of the seek bar through the input device 52 (for example, a touch panel), it is possible to display an image of any place in a time series in the work support image 400 as a moving image on the display device 50A. Accordingly, the operator or the supervisor can operate the seek bar through the input device 52 to fast-forward or rewind the work support image 400 to any position. Therefore, the management system SYS can improve the convenience of the operator and the supervisor.

The thumbnail display area 406 is a screen area in which a thumbnail image corresponding to the work support image 400 at any point in a time series of the work support image 400 is displayed when the any point is designated on the operation image 405 (seek bar) through the input device 52.

In the thumbnail display area 406, actually, a thumbnail image of one place designated on the seek bar is displayed, but in this example, for convenience, thumbnail images 400A to 400C when three different places on the seek bar are designated are displayed.

The thumbnail image 400A represents the work support image 400 at the first stage in a time series among the thumbnail images 400A to 400C. To be more specific, the thumbnail image 400A represents a state of a preparation in which the shovel 100 performs positioning for performing the slope face construction work.

The thumbnail image 400B represents the work support image 400 at the middle stage in a time series among the thumbnail images 400A to 400C. To be more specific, the thumbnail image 400B represents a state of a preparation step in which positioning on the slope is completed and the tip end (bucket 6) of the attachment AT is extended toward the slope to be processed.

The thumbnail image 400C represents the work support image 400 at the last stage in a time series among the thumbnail images 400A to 400C. To be specific, the thumbnail image 400C represents a state in which the shovel 100 causes the distal end (bucket 6) of the attachment AT to be abutted and starts the slope face construction work.

When the position of the work support image 400 in the time series is advanced on the seek bar as in the thumbnail images 400A to 400C, a state in which the shovel 100 extends the tip end (bucket 6) of the attachment onto the slope and brings the bucket 6 into contact with the slope is displayed. As a result, the operator or the supervisor can specify a portion that he or she actually wants to see on the seek bar while checking the thumbnail image.

As described above, in this example, the display device 50A displays, under the control of the display processing unit 303, information (the work support image 400) related to a plurality of processes including information associating previous and subsequent processes among a plurality of processes performed by the shovel 100 in a time series. To be specific, the display device 50A displays the work support image 400 including information (the work teaching image 404) on how to proceed to the preparation process in consideration of the main work process (the slope construction work).

As a result, the operator can proceed with the preparation process in consideration of the main work process even when the operator has little experience in the main work. Similarly, the supervisor can monitor the preparation process in consideration of the main work process even when the supervisor has little experience in monitoring the main work. Therefore, the management system SYS can relatively improve the work efficiency and safety of the shovel 100 even when an operator with a relatively low level of skill performs an operation or when a supervisor with a relatively low level of experience performs monitoring.

In addition, in the present example, the display device 50A displays the information related to the content of each of the plurality of processes and the information associating the previous and subsequent processes in a time series in accordance with the execution order of the plurality of processes. To be more specific, the display device 50A displays the contents of the preliminary processes (see the thumbnail images 400A and 400B) earlier in a time series, and the contents of the main work process, that is, the process of the slope face construction work (see the thumbnail image 400C) will be described later in a time series. When the content of the preparation step is displayed as the work support image 400, the display device 50A displays the work teaching image 404 in accordance with the content.

Accordingly, the operator or the supervisor can grasp the contents of the plurality of processes, the information (the work teaching image 404) associating the previous and subsequent processes, and the like in accordance with the actual flow of the plurality of processes. Therefore, the operator or the supervisor can more appropriately understand the contents of the plurality of processes, the information for associating the previous and subsequent processes, and the like. Therefore, the management system SYS can further improve the work efficiency and safety of the shovel 100.

In addition, in this example, the display device 50A rewinds the content displayed in a time series in response to a predetermined input inputted through the input device 52, and displays information related to a step of a relatively previous stage among the plurality of steps. In addition, the display device 50A advances the content displayed in a time series in response to a predetermined input inputted through the input device 52, and displays information related to a process in a relatively subsequent stage among the plurality of processes.

As a result, the operator or the supervisor of the shovel 100 can, as appropriate, attentively check a portion desired to be checked in a time series many times or skip a portion which does not need to be checked in the work support image 400 as a moving image. Therefore, the management system SYS can improve the convenience of the operator. In addition, the operator or the supervisor can more appropriately understand the work including the plurality of processes. Therefore, the management system SYS can further improve the work efficiency and safety of the shovel 100.

<Second Example of Work Support Image>

Figure 5:
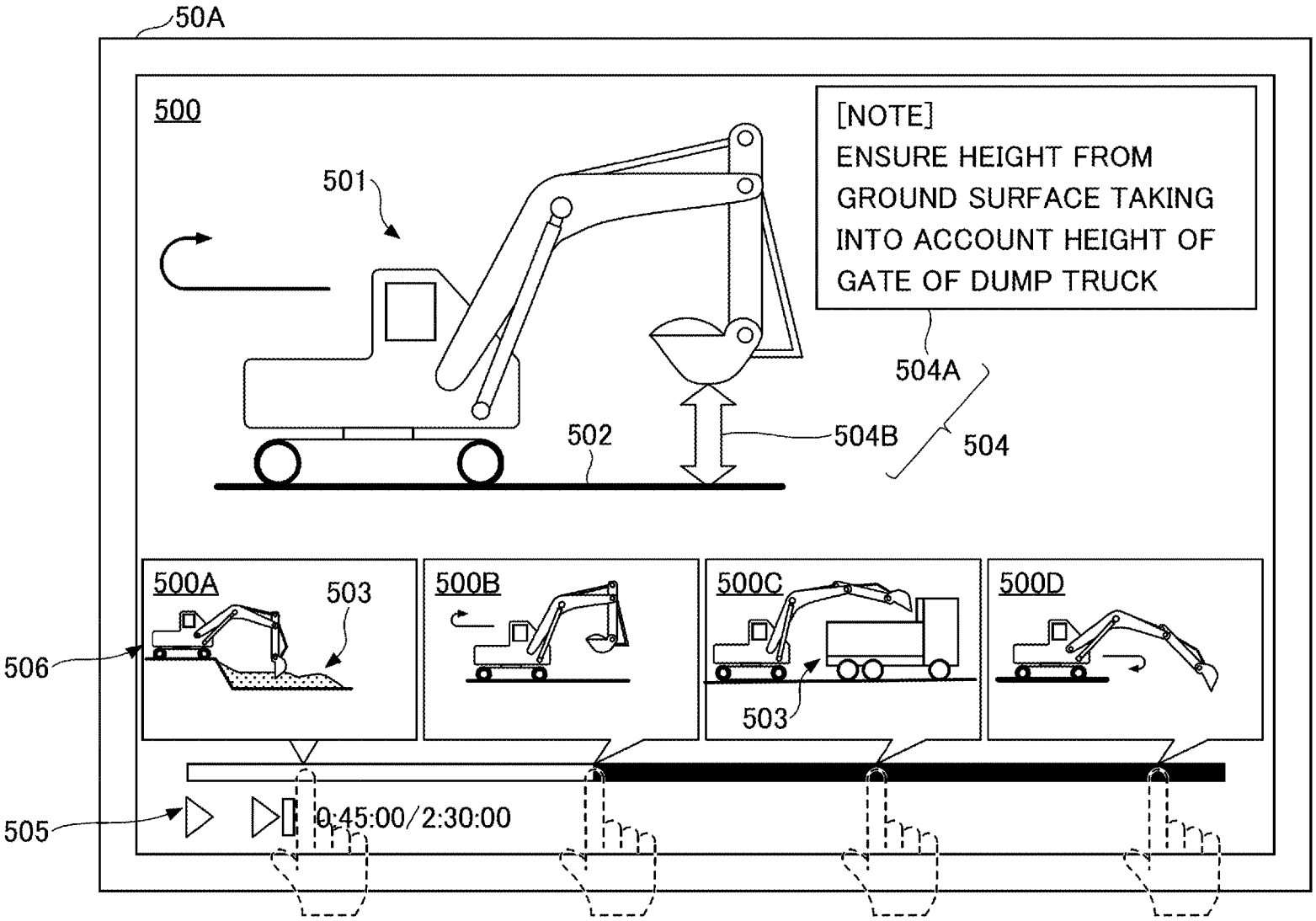
FIG. 5 is a diagram showing a second example of a work support image displayed on the display device.

FIG. 5 is a diagram illustrating a second example (work support image 500) of the work support image displayed on the display device 50A. To be more specific, FIG. 5 is a diagram showing a specific example (work support image 500) of the second work support image displayed on the display device 50A.

As illustrated in FIG. 5, the work support image 500 is a moving image illustrating the content of the work (loading work) of loading the dump truck with the earth and sand scooped up by the bucket 6 through the excavation operation, in a side view of the shovel 100. The loading operation includes a series of a plurality of operation steps including a step of an excavation operation (see the thumbnail image 500A), a step of a boom raising and turning operation (see the thumbnail image 500B), a step of a dumping operation (see the thumbnail image 500C), and a step of a boom lowering and turning operation (see the thumbnail image 500D).

As in the case of the above-described first example, the work support image 500 includes the shovel image 501, the work plane image 502, the work target image 503, the work teaching image 504, the operation image 505, and the thumbnail display area 506.

The work target image 503 includes an area to be excavated (see the thumbnail image 500A) and an image of a dump truck at a discharge destination (see the thumbnail image 500C).

As in the first example described above, the operation image 505 includes a seek bar.

In this example (FIG. 5), the seek bar indicates that a portion of the work support image 500 as a moving image of 2 minutes and 30 seconds in total, which is 45 seconds ahead of the start point, is reproduced, that is, displayed on the display device 50A.

In addition, as in the case of the above-described first example, by designating any position of the seek bar through the input device 52, it is possible to display an image of any place in a time series in the work support image 500 as a moving image on the display device 50A.

In addition, as in the case of the above-described first example, by designating any position of the seek bar through the input device 52, it is possible to display an image of any place in a time series in the work support image 500 as a moving image on the display device 50A.

In the thumbnail display area 506, actually, a thumbnail image of one place designated on the seek bar is displayed, but in this example, for convenience, thumbnail images 500A to 500D when four different places on the seek bar are designated are displayed.

The thumbnail image 500A represents the work support image 500 at the first stage in a time series among the thumbnail images 500A to 500D. To be specific, the thumbnail image 500A represents a state in which the shovel 100 is performing an excavation operation.

The thumbnail image 500B represents the work support image 500 of the next stage after the thumbnail image 500A in a time series among the thumbnail images 500D to 500A. To be specific, the thumbnail image 500B represents a state in which the shovel 100 performs the boom raising and turning operation. The thumbnail image 500B corresponds to the content of the work support image 500 currently displayed on the display device 50A.

The thumbnail image 500C represents the work support image 500 of the next stage after the thumbnail image 500B in a time series among the thumbnail images 500A to 500D. To be specific, the thumbnail image 500C represents a state in which the shovel 100 performs the dumping operation with respect to the dump truck.

The thumbnail image 500D represents the work support image 500 at the last stage among the thumbnail images 500A to 500D.

In this example, as described above, the display device 50A displays an image corresponding to the thumbnail image 500B as the work support image 500, that is, a state in which the shovel 100 is performing the boom raising and turning operation.

In the present example, the work teaching image 504 includes work teaching images 504A and 504B.

In the work teaching image 504A, character information for teaching the point of work in consideration of the earth discharging operation which is the next process of the boom raising and turning operation is displayed. To be specific, in the work teaching image 504A, it is described that "Be aware of the height of the gate of the dump truck and secure the height from the ground". As a result, the operator can operate the shovel 100 (attachment AT) corresponding to the boom raising and turning operation so as to ensure a sufficient height of the bucket 6 from the ground with awareness of the next step even when the operator has relatively little experience in the loading operation. In addition, the supervisor can monitor the operation of the complete automatic shovel 100 while being aware of the height of the bucket 6 from the ground during the boom raising and turning operation.

The work teaching image 504B is an image of a double-headed arrow that emphasizes the height of the bucket 6 from the ground surface taught by the character information of the work teaching image 504A. Accordingly, the operator or the supervisor can more clearly grasp the height of the bucket 6 from the ground, which is the point.

As described above, in this example, the display device 50A displays, under the control of the display processing unit 303, information (the work support image 400) related to a plurality of processes including information associating previous and subsequent processes among a plurality of processes performed by the shovel 100 in a time series. To be specific, the display device 50A displays the work support image 500 including information (the work teaching image 504) on how to proceed to a relatively previous step (the boom raising and turning operation) in consideration of a relatively subsequent step (the dumping operation) in one work step (the loading work) including a plurality of operation steps.

Accordingly, even when the operator has little experience in the work including the series of the plurality of operation processes, the operator can proceed to the relatively earlier operation process in consideration of the relatively subsequent operation process. Similarly, even in a case where the supervisor has little experience in monitoring a work including a series of a plurality of operation processes, the supervisor can monitor a relatively earlier operation process in consideration of a relatively subsequent operation process. Therefore, the management system SYS can relatively improve the work efficiency and safety of the shovel 100 even when an operator with a relatively low level of skill performs an operation or when a supervisor with a relatively low level of experience performs monitoring.

In addition, in the present example, the display device 50A displays the information related to the content of each of the plurality of processes and the information associating the previous and subsequent processes in a time series in accordance with the execution order of the plurality of processes. To be specific, the display device 50A displays the contents of the plurality of operation steps (the excavation operation, the boom raising and turning operation, the earth discharging operation, and the boom lowering and turning operation) in a time series in accordance with the order (see the thumbnail images 500A to 500D). Then, for example, when the content of the boom raising and turning operation is displayed as the work support image 500, the display device 50A displays the work teaching image 504 in accordance with the content.

Accordingly, the operator or the supervisor can grasp the contents of the plurality of operation processes, the information (work teaching image 504) associating the previous and subsequent operation processes, and the like in accordance with the actual flow of the plurality of operation processes. Therefore, the operator or the supervisor can more appropriately understand the contents of the plurality of operation steps, the information for associating the previous and subsequent operation steps, and the like. Therefore, the management system SYS can further improve the work efficiency and safety of the shovel 100.

In addition, in this example, the display device 50A rewinds the content displayed in a time series in response to a predetermined input inputted through the input device 52, and displays information related to a step in a relatively previous stage among the plurality of operation steps. In addition, the display device 50A advances the contents displayed in a time series in response to a predetermined input inputted through the input device 52, and displays information related to a step in a relatively subsequent stage among the plurality of operation steps.

As a result, the operator or the supervisor of the shovel 100 can, as appropriate, attentively check a portion desired to be checked in a time series many times or skip a portion which does not need to be checked in the work support image 500 as a moving image as appropriate. Therefore, the management system SYS can improve the convenience of the operator. In addition, the operator or the supervisor can more appropriately understand the work including the plurality of operation steps. Therefore, the management system SYS can further improve the work efficiency and safety of the shovel 100.

<Third Example of Work Support Image>

Figure 6:
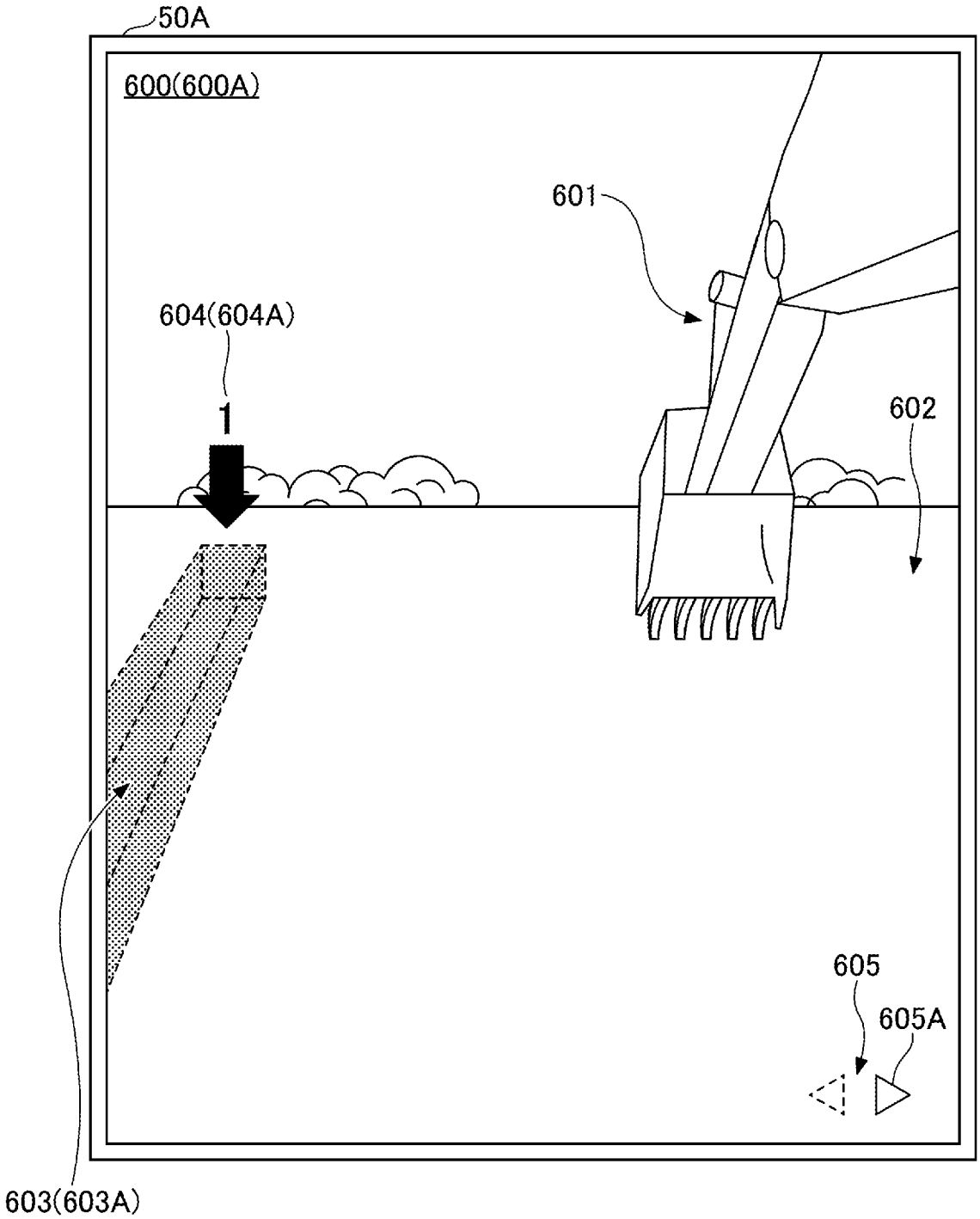
FIG. 6 is a diagram showing a third example of a work support image displayed on the display device.
Figure 7:
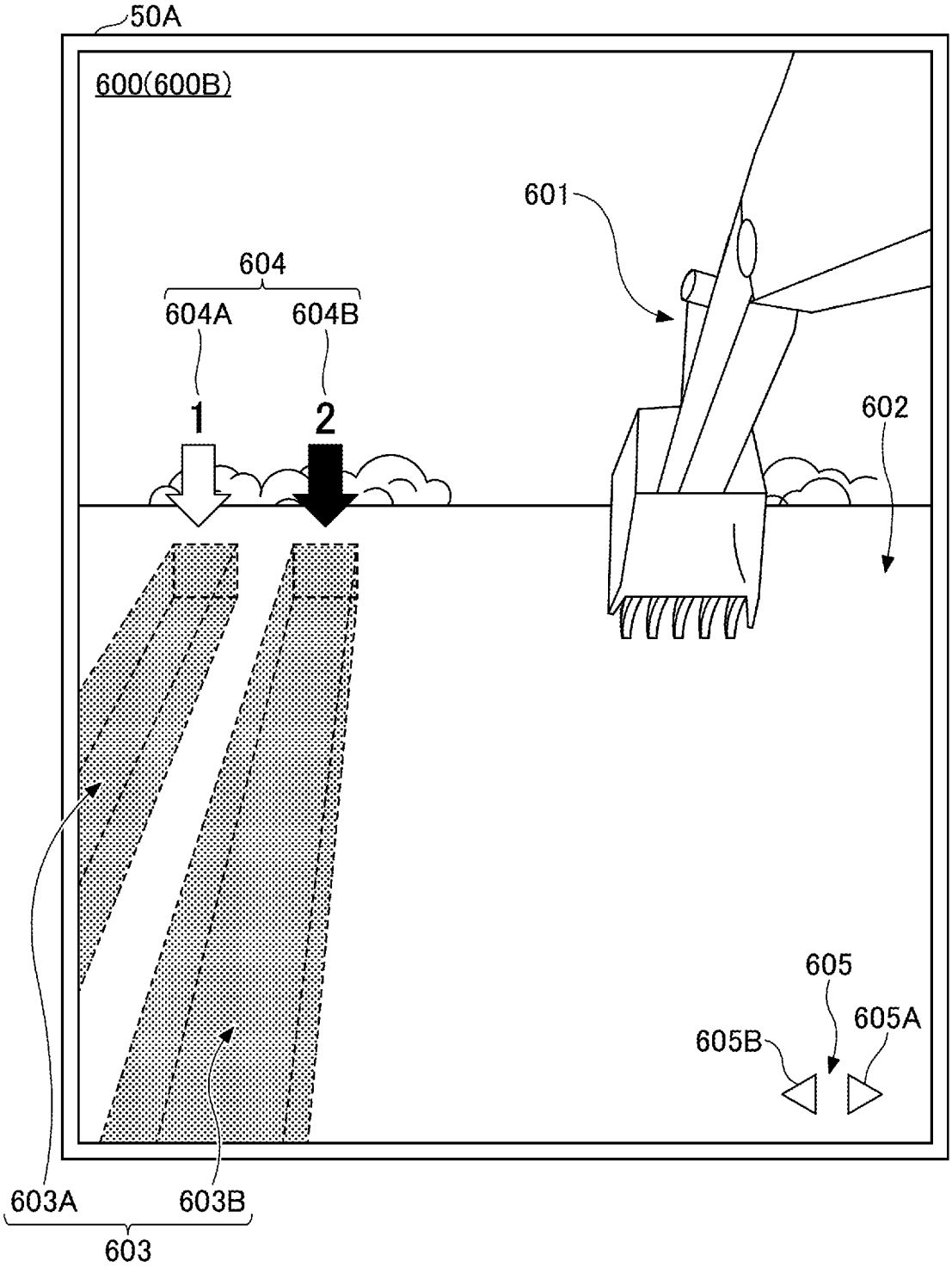
FIG. 7 is a diagram showing the third example of the work support image displayed on the display device.
Figure 8:
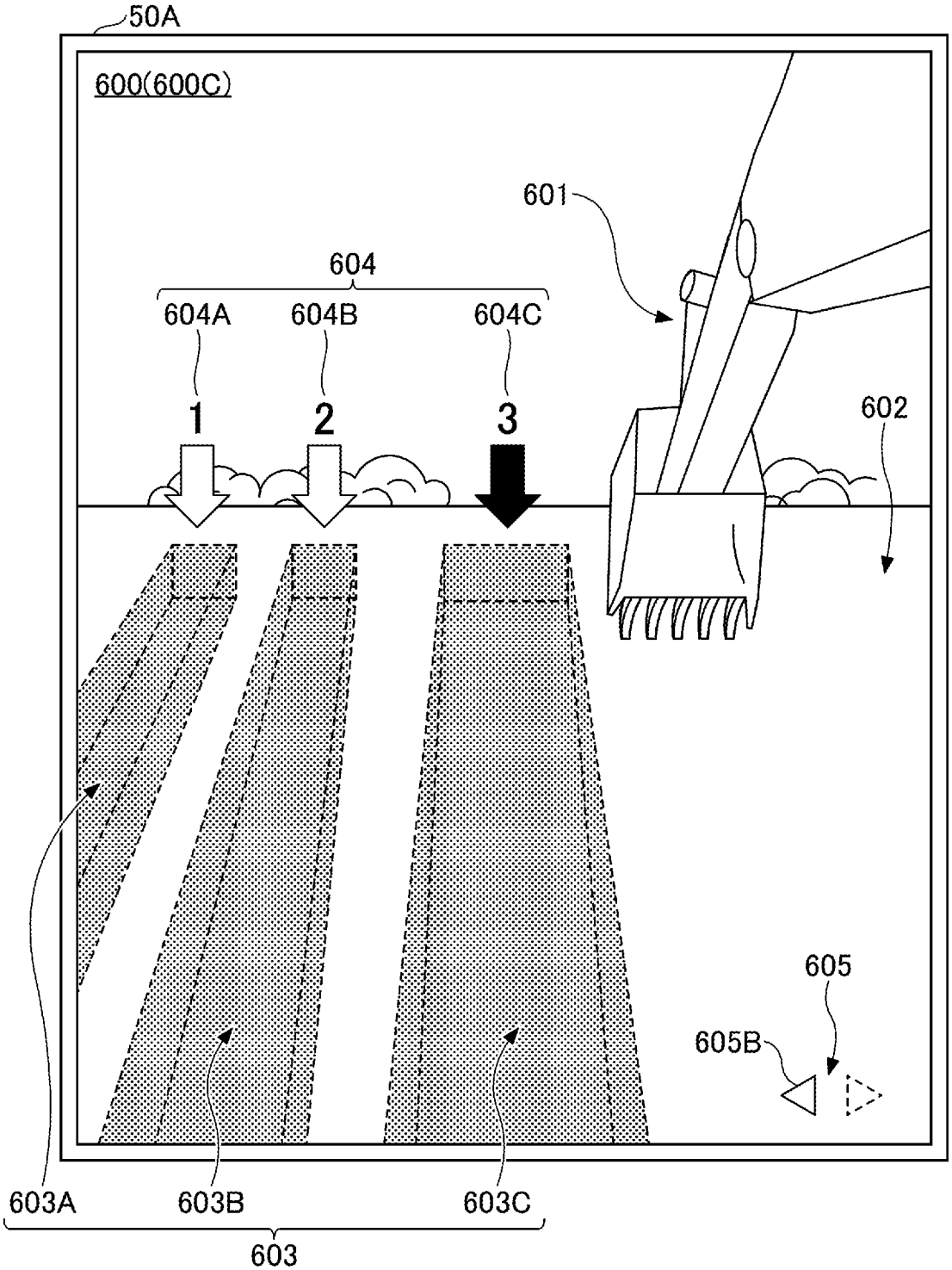
FIG. 8 is a diagram showing the third example of the work support image displayed on the display device.

FIGS. 6 to 8 are diagrams illustrating a third example (work support image 600) of the work support image displayed on the display device 50A. To be specific, FIGS. 6 to 8 are diagrams illustrating specific examples (work support image 600) of the third support image displayed on the display device 50A.

As illustrated in FIGS. 6 to 8, the work support image 600 is a slide show (work support images 600A to 600C) illustrating the content of the work in which the shovel 100 constructs three trenches extending substantially parallel to each other by the excavation work from a viewpoint viewed from the operator of the cabin 10.

The work support image 600 includes a shovel image 601, a work plane image 602 (an example of first image information), a work target image 603 (an example of second image information), a work teaching image 604, and an operation image 605, as in the case of the above-described first example and the like.

As shown in FIG. 6, the work support image 600A represents the first (initial) stage in a time series among the work support images 600A to 600C.

In the work support image 600A, a work target image 603A as the work target image 603 is displayed. The work target image 603A represents one trench at the left end on the screen among the three trenches to be constructed.

In addition, the work support image 600A as the work teaching image 604 is displayed in the work teaching image 604A. The work teaching image 604A includes numerical information ("1") indicating that one trench at the left end on the screen at the left end on the screen is to be constructed first and an icon image of an arrow.

As addition, as illustrated in FIG. 7, the work support image 600B represents an intermediate (middle) stage in a time series among the work support images 600A to 600C.

In the work support image 600B, a work target image 603 including work target images 603A and 603B is displayed. The work target image 603B represents the middle trench among the three trenches to be constructed.

In the work support image 600B, a work teaching image 604 including the work teaching images 604A and 604B is displayed. The work teaching image 604B includes numerical information ("2") indicating that the middle one of the three trenches to be constructed is to be constructed second and an icon image of an arrow.

As illustrated in FIG. 8, the work support image 600C represents the last (final) stage in the time series among the work support images 600A to 600C.

In the work support image 600C, a work target image 603 including work target images 603A to 603C is displayed. The work target image 603C represents the trench at the right end on the screen among the three trenches to be constructed.

In the work support image 600C, a work teaching image 604 including the work teaching images 604A to 604C is displayed. The work teaching image 604C includes numerical information ("3") indicating that one of the three trenches to be constructed at the right end on the screen is to be constructed third and an icon image of an arrow.

The operation image 605 is arranged at the lower right corner of the work support image 600. The operation image 605 is used to advance or return a slide show including the work support images 600A to 600C in a time series.

As shown in FIG. 6, in the work support image 600A, an operation image 605 including a switching icon 605A for advancing the target operation one step ahead in a time series in the slide show is displayed. To be specific, in the work support image 600A, the switching icon 605A is used to switch the display content of the display device 50A to the work support image 600B.

In addition, as shown in FIG. 7, in the work support image 600B, an operation image 605 including a switching icon 605A for advancing the target operation one step ahead in a time series and a switching icon 605B for returning the target operation one step before in a time series is displayed in the slide show. To be more specific, in the work support image 600B, the switching icon 605A is used to switch the display content of the display device 50A to the work support image 600C, and the switching icon 605B is used to switch the display content of the display device 50A to the work support image 600A.

As shown in FIG. 8, in the work support image 600C, an operation image 605 including a switching icon 605B for returning the target operation to the previous operation in a time series in the slide show is displayed. To be specific, in the work support image 600C, the switching icon 605B is used to switch the display content of the display device 50A to the work support image 600B.

In addition, the operator, the supervisor, or the like can operate the switching icon 605A of the operation image 605 through the input device 52 to check the work support images 600A to 600C in accordance with the progress of the target work in a time series. Therefore, even when the degree of skill is relatively low, the operator can proceed with the actual work after grasping the order (setup) of the work for constructing the three trenches. Therefore, the operator can proceed with the work more smoothly and safely, and the management system SYS can improve the work efficiency and safety of the shovel 100. In addition, even in a case where the monitoring experience is relatively shallow, the supervisor can monitor the actual work of the complete automatic shovel 100 after grasping the order (setup) of the work of constructing the three trenches. Therefore, by performing an intervention operation in a situation where the shovel 100 is performing work in an inappropriate order, it is possible to correct the work of the complete automatic shovel 100, and the management system SYS can improve the work efficiency and safety of the shovel 100.

In addition, the operator, the supervisor, or the like can operate the switching icons 605A and 605B of the operation image 605 through the input device 52 to move the work support image 600 forward in accordance with the progress of the target operation or move back in accordance with the progress of the target operation.

As described above, in this example, the display device 50A displays, under the control of the display processing unit 303, information (work support images 600A to 600C)

related to a plurality of processes including information associating previous and subsequent processes among a plurality of processes performed by the shovel 100 in a time series. To be specific, the display device 50A displays work support image 500 including information (work teaching image 604) related to a setup of a plurality of works (works of constructing three trenches) that can be performed in at least two or more different orders in a time series.

As a result, even when the operator has little experience of the work at the site, the operator can advance the actual work after grasping the setup of the plurality of work processes in advance. Similarly, even when the supervisor has little experience in the monitoring work, the supervisor can perform the actual monitoring work after grasping the setup of the plurality of work processes in advance. Therefore, the management system SYS can relatively improve the work efficiency and safety of the shovel 100 even when an operator with a relatively low level of skill performs an operation or when a supervisor with a relatively low level of experience performs monitoring.

In addition, in the present example, the display device 50A displays the information related to the content of each of the plurality of processes and the information associating the previous and subsequent processes in a time series in accordance with the execution order of the plurality of processes. To be specific, the display device 50A displays the contents of the plurality of work processes (work of constructing each of the three ditches) in a time series in accordance with the order (work support images 600A to 600C). Then, the display device 50A displays the work support images 600A to 600C in the order of the work teaching images 604A to 604C in accordance with the progress of the target work.

Accordingly, the operator or the supervisor can grasp the contents of the plurality of processes, the information (the work teaching image 604) associating the previous and subsequent processes, and the like in accordance with the actual flow of the plurality of processes. Therefore, the operator or the supervisor can more appropriately understand the contents of the plurality of processes, the information for associating the previous and subsequent processes, and the like. Therefore, the management system SYS can further improve the work efficiency and safety of the shovel 100.

In addition, in the present example, the display device 50A rewinds the content displayed in a time series in response to a predetermined input inputted through the input device 52, and displays information related to a step in a relatively previous stage among the plurality of work steps. In addition, the display device 50A advances the contents displayed in a time series in response to a predetermined input inputted through the input device 52, and displays information related to a process in a relatively subsequent stage among the plurality of work processes.

As a result, the operator or the supervisor of the shovel 100 can attentively check a portion desired to be checked in a time series many times among the work support images 600A to 600C as the slide show, or can skip a portion which does not need to be checked. Therefore, the management system SYS can improve the convenience of the operator. In addition, the operator or the supervisor can more appropriately understand the work including the plurality of processes. Therefore, the management system SYS can further improve the work efficiency and safety of the shovel 100.

In addition, in the present example, the display device 50A displays the work target image 603 (603A to 603C) representing the range of the work target for each of the plurality of work processes in the site in a superimposed manner on the work plane image 602 representing the site in which the plurality of work processes are executed.

Accordingly, the operator or the supervisor can grasp the range of the work target (a range of a construction target) for each work process in a site where a plurality of work processes are executed, and proceed with an actual work or proceed with an actual monitoring task. Therefore, the management system SYS can further improve the work efficiency and safety of the shovel 100.

<Fourth Example of Work Support Image>

Figure 9:
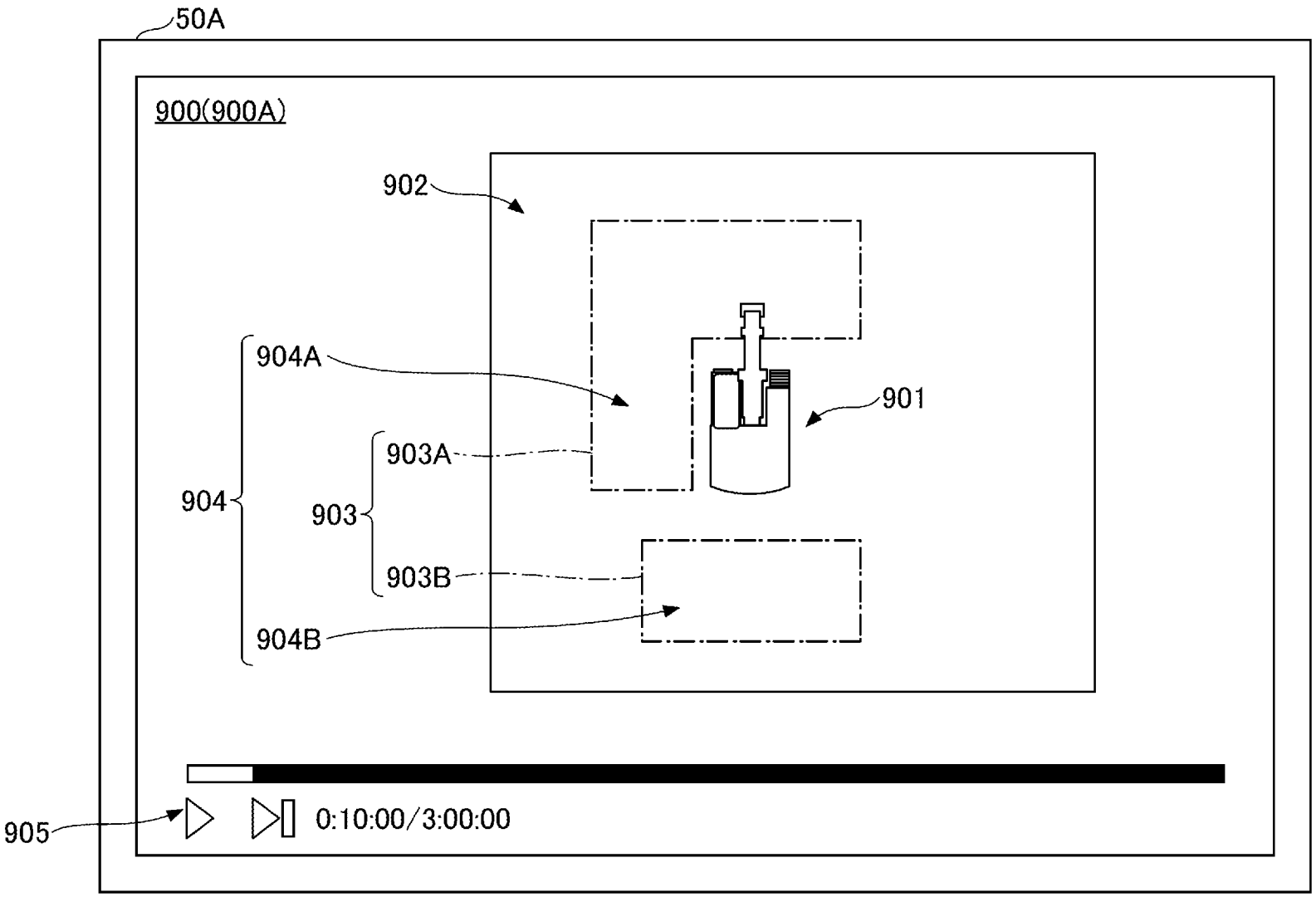
FIG. 9 is a diagram showing a fourth example of a work support image displayed on the display device.
Figure 10:
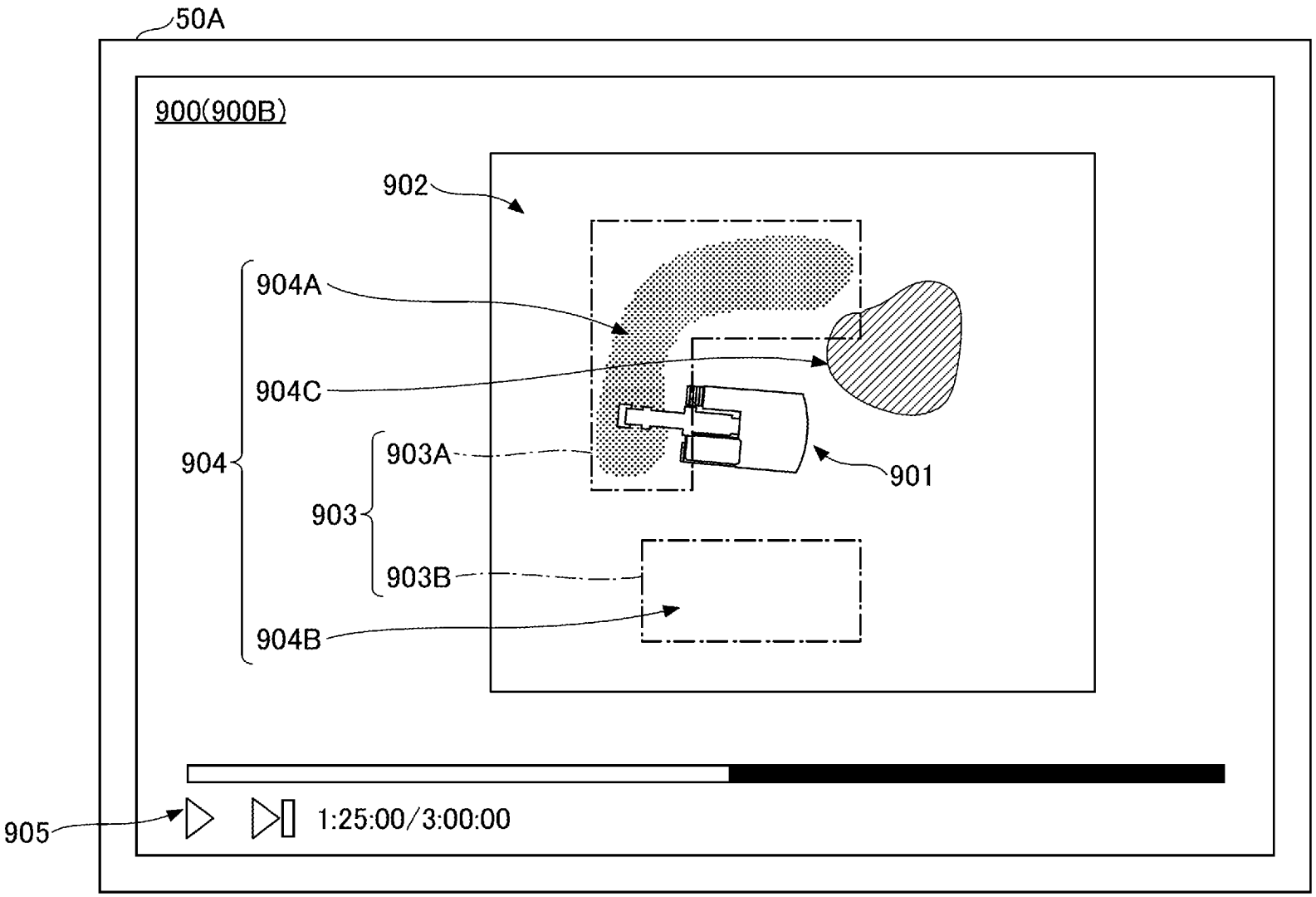
FIG. 10 is a diagram showing the fourth example of the work support image displayed on the display device.
Figure 11:
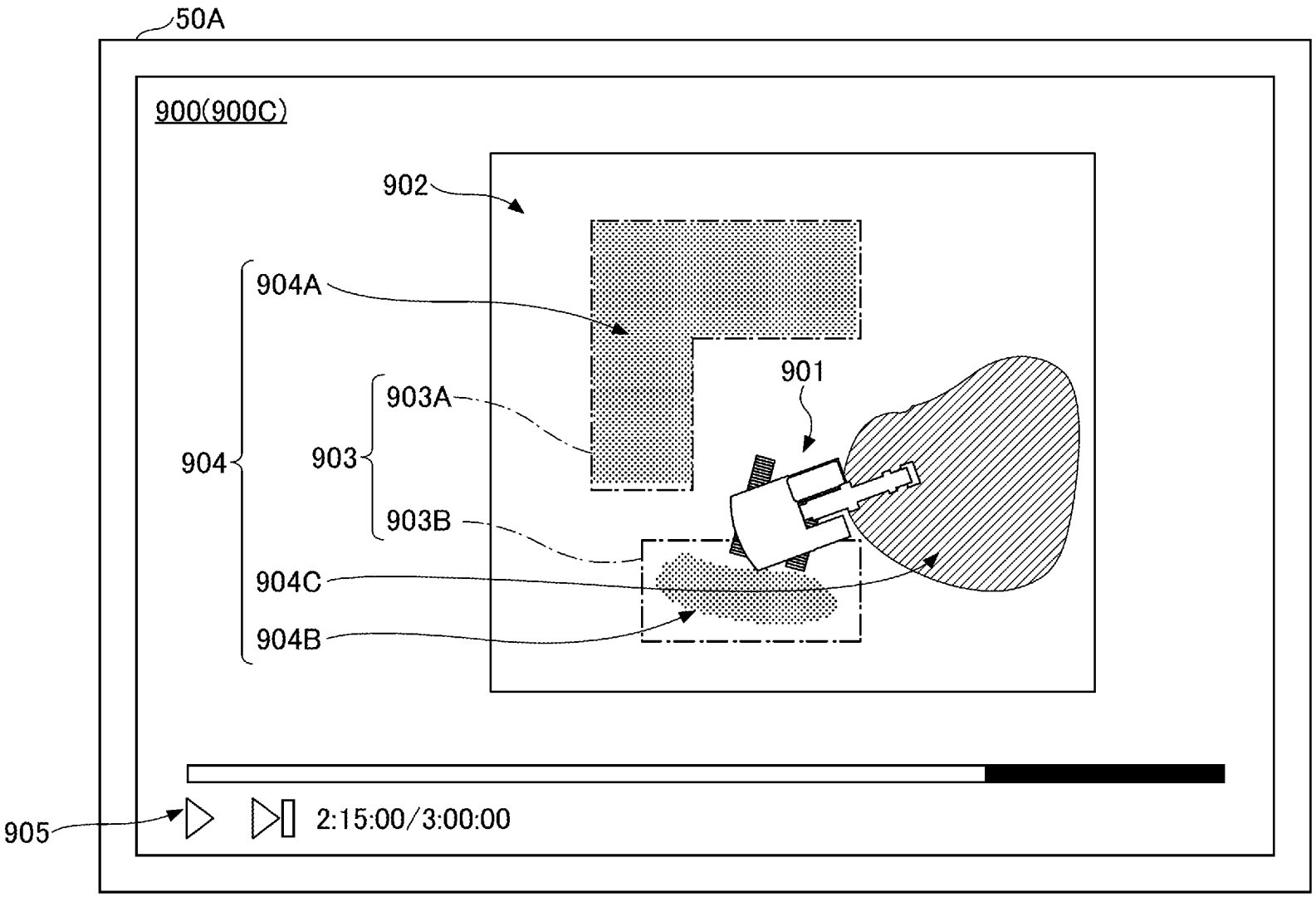
FIG. 11 is a diagram showing the fourth example of the work support image displayed on the display device.
Figure 12:
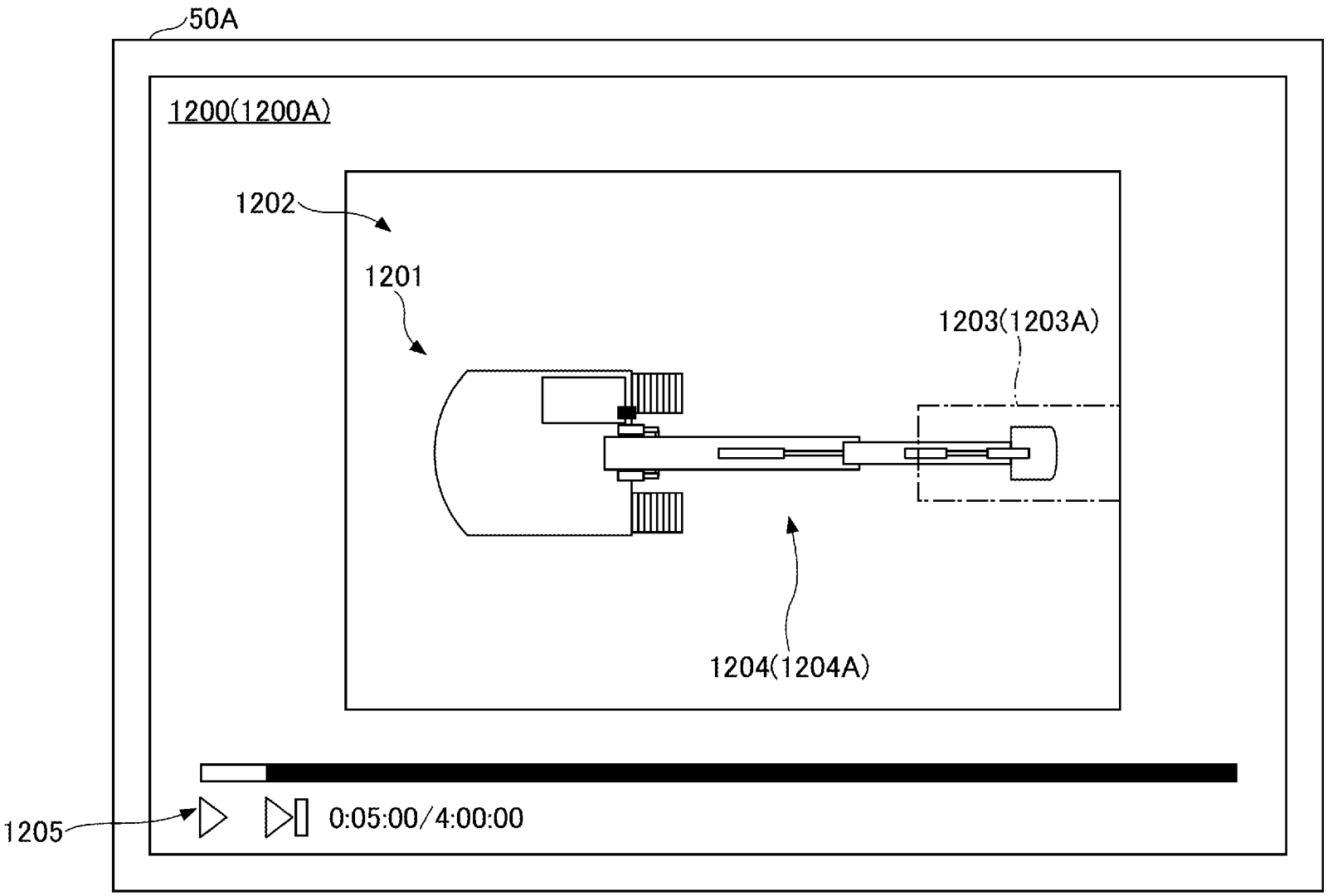
FIG. 12 is a diagram showing a fifth example of a work support image displayed on the display device.
Figure 13:
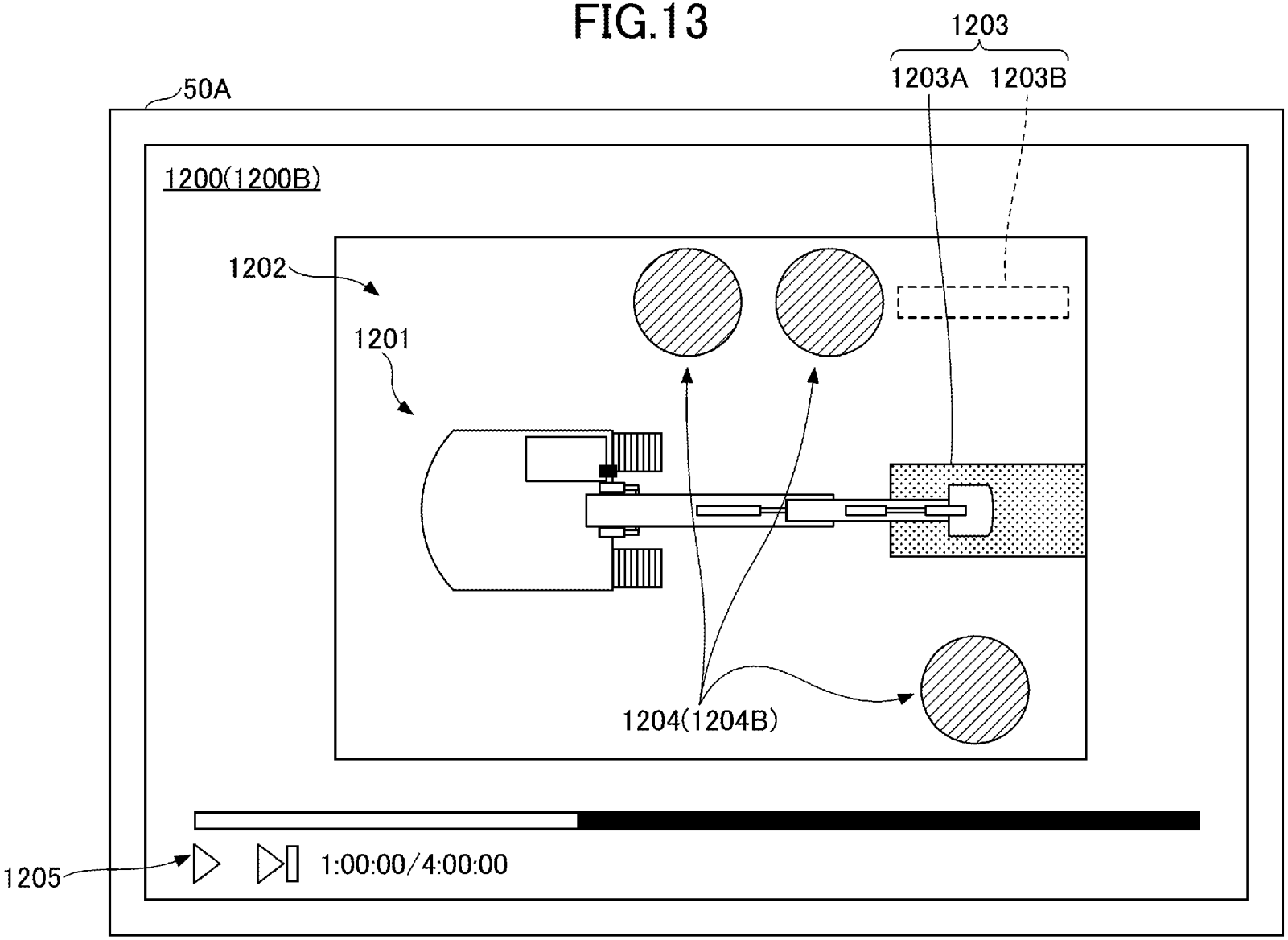
FIG. 13 is a diagram showing the fifth example of the work support image displayed on the display device.
Figure 14:
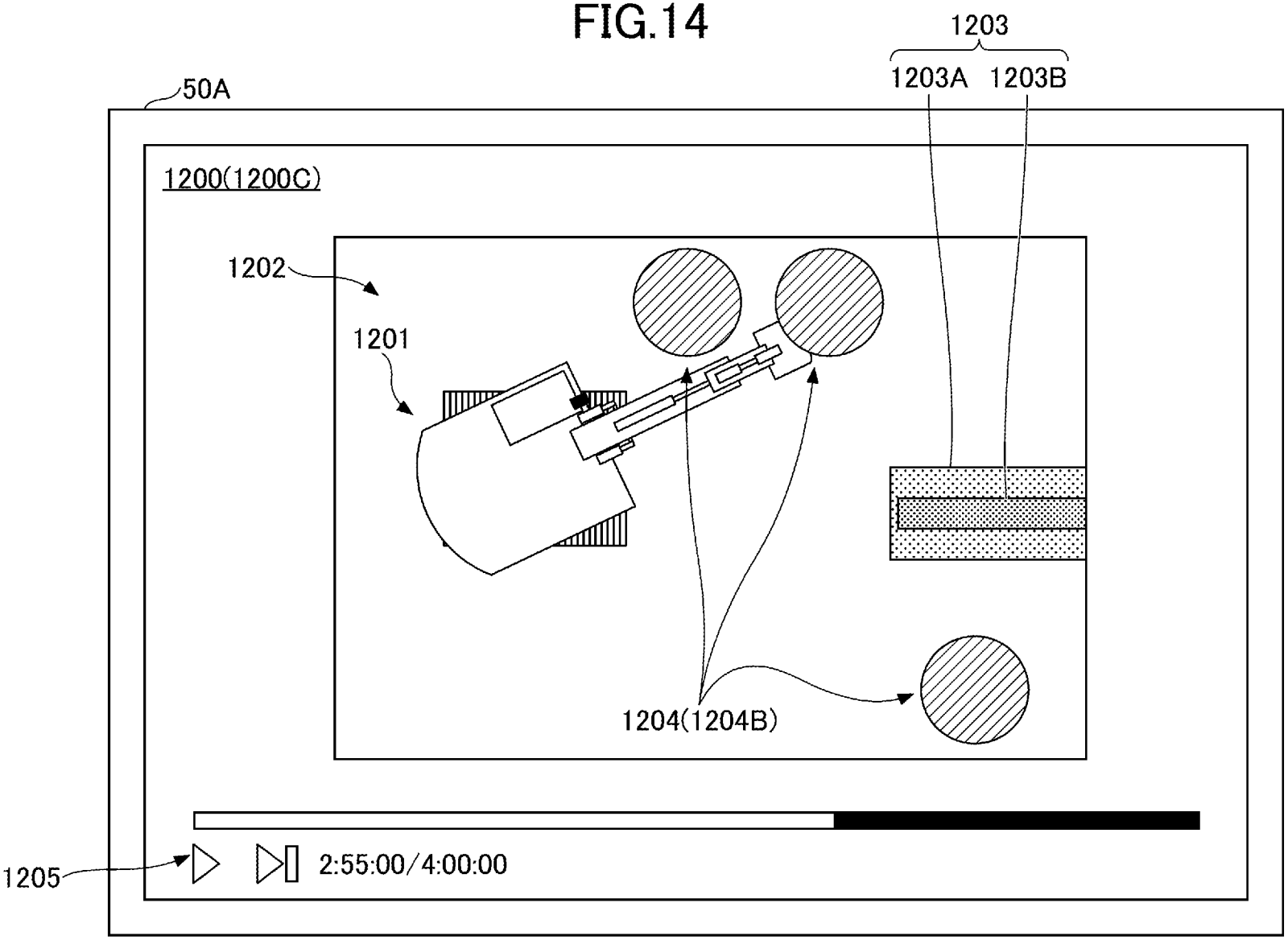
FIG. 14 is a diagram showing the fifth example of the work support image displayed on the display device.
Figure 15:
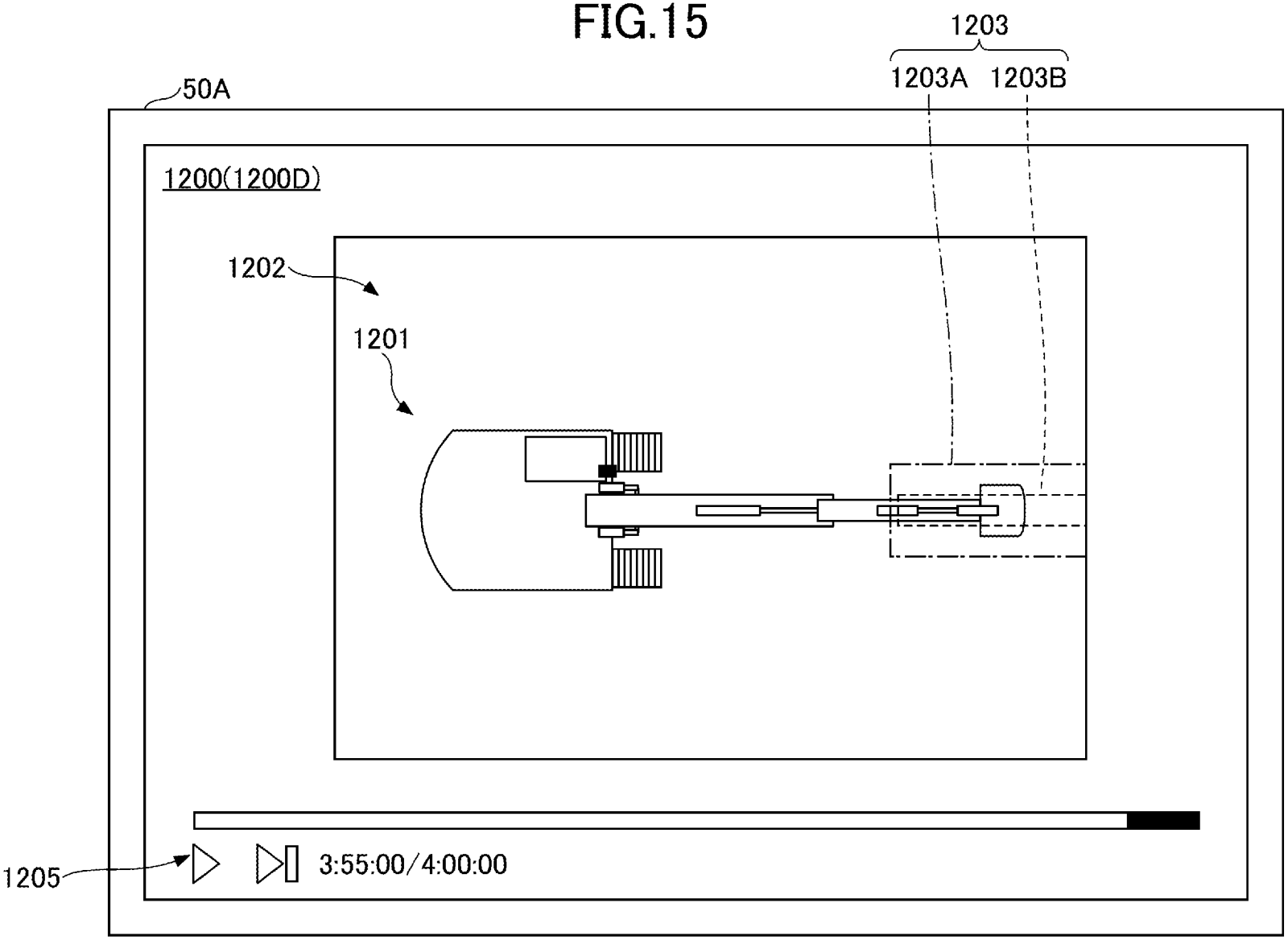
FIG. 15 is a diagram showing the fifth example of the work support image displayed on the display device.

FIGS. 9 to 11 are diagrams illustrating a fourth example (work support image 900) of the work support image displayed on the display device 50A. To be specific, FIGS. 9 to 11 are diagrams illustrating specific examples (work support image 900) of the third support image displayed on the display device 50A.

As illustrated in FIGS. 9 to 11, the work support image 900 is a moving image illustrating the content of the work of constructing two holes at different places of the work site by the excavation work in a top view of the shovel 100.

The work support image 900 includes a shovel image 901, a work plane image 902 (an example of first image information), a work target image 903, a work teaching image 904, and an operation image 905, as in the case of the above-described first example and the like.

The work target image 903 (an example of second image information) includes work target images 903A and 903B.

The work target images 903A and 903B each represent a place where two holes are to be formed.

The work target image 903A represents an L-shaped hole to be constructed in a top view at an upper portion in the drawing in the work site corresponding to the work plane image 902.

The work target image 903B represents a rectangular hole to be constructed in a top view at a lower portion in the drawing in the work site corresponding to the work plane image 902.

The work teaching image 904 includes work teaching images 904A to 904C.

The work teaching image 904A represents a progressing state of construction of the hole corresponding to the work target image 903A. To be specific, the work teaching image 904A represents a region (a dotted portion) in which the excavation work is in progress or has been completed in the range of the entire hole corresponding to the work target image 903A. In addition, the work teaching image 904A may indicate whether the excavation work is in progress or completed by shading or the like of a dotted finish.

The work teaching image 904B represents a progressing state of construction of the hole corresponding to the work target image 903B. To be specific, the work teaching image 904B represents a region (a dotted portion) in which the excavation work is in progress or has been completed in the range of the entire hole corresponding to the work target image 903B. In addition, the work teaching image 904B may indicate whether the excavation work is in progress or has been completed by shading or the like.

The work teaching image 904C represents a temporary storage place (earth removal pile) of earth and sand discharged by the excavation work (hatched portion).

The operation image 905 includes a seek bar as in the case of the first example and the like described above.

In the present example (FIGS. 9 to 11), the seek bar indicates that, in work support image 900 as a moving image of three minutes in total, portions advanced by 10 seconds, 1 minute 25 seconds, and 2 minutes 15 seconds from the start point are reproduced, that is, displayed on the display device 50A.

In addition, as in the case of the above-described first example and the like, by designating any position of the seek bar through the input device 52, it is possible to display an image of any place in a time series in the work support image 900 as a moving image on the display device 50A.

In addition, as in the case of the above-described first example and the like, by designating any position of the seek bar through the input device 52, it is possible to display an image of any place in a time series in the work support image 500 as a moving image on the display device 50A.

As in the case of the above-described first example and the like, when any position in a time series of the work support image 900 is designated on the operation image 905 (seek bar) through the input device 52, a thumbnail image corresponding to the work support image 900 of the position may be displayed.

The work support image 900 includes work support images 900A to 900C as still images constituting one scene of the moving image.

The work support image 900A represents a stage immediately after the start (10 seconds after the start point) in a time series in the work support image 900 as a moving image. To be specific, the work support image 900A represents a state before excavation work for two holes is started, and represents a state in which the shovel 100 directs the attachment AT to an L-shaped hole in a top view corresponding to the work target image 903A.

The work support image 900B represents a middle stage (1 minute and 25 seconds after the start point) in a time series in the work support image 900 as a moving image. To be specific, the work support image 900B represents a state in which the excavation work of the hole having an L shape in a top view corresponding to the work target image 903A of the two holes is in progress. Accordingly, by checking the work teaching images 904A and 904B, the operator or the supervisor can recognize that the L-shaped hole in the top view corresponding to the work target image 903A out of the two holes may be constructed first. In addition, by checking the work teaching image 904C, the operator or the supervisor can grasp the position of the temporary storage place of the earth and sand discharged from the ground surface in the excavation work with respect to the hole to be constructed.

The work support image 900C represents the final stage (2 minutes and 25 seconds after the start point) in the time series in the work support image 900 as a moving image. To be specific, the work support image 900C represents a state in which the excavation work of an L-shaped hole in a top view corresponding to the work target image 903A among the two holes is completed and the excavation work of a rectangular hole in a top view corresponding to the work target image 903B is in progress. Accordingly, by checking the work teaching images 904A and 904B, the operator or the supervisor can understand that the remaining holes may be constructed after the completion of the excavation work of the L-shaped hole. In addition, by confirming the work teaching image 904C, the operator or the supervisor can grasp, after completion of construction of the hole corresponding to the work target image 903A, arrangement such as movement of earth and sand of the earth unloading pile and a movement destination thereof (a location of a new earth unloading pile) in accordance with the start of construction of the hole corresponding to the work target image 903B.

As described above, in this example, the display device 50A displays, under the control of the display processing unit 303, information (the work support image 900) related to a plurality of processes including information associating previous and subsequent processes among a plurality of processes performed by the shovel 100 in a time series. To be specific, the display device 50A displays the work support image 900 including information (work teaching images 904A to 904C) related to a setup of a plurality of works (works of constructing two holes) which can be performed in at least two or more different orders in a time series.

As a result, even when the operator has little experience of the work at the site, the operator can advance the actual work after grasping the setup of the plurality of work processes in advance. Similarly, even when the supervisor has little experience in the monitoring work, the supervisor can perform the actual monitoring work after grasping the setup of the plurality of work processes in advance. Therefore, the management system SYS can relatively improve the work efficiency and safety of the shovel 100 even when an operator with a relatively low level of skill performs an operation or when a supervisor with a relatively low level of experience performs monitoring.

In addition, in the present example, the display device 50A displays the information related to the content of each of the plurality of processes and the information associating the previous and subsequent processes in a time series in accordance with the execution order of the plurality of processes. To be specific, the display device 50A displays the contents of a plurality of work processes (work for constructing each of two holes) in a time series in accordance with the order of the work processes. Then, the display device 50A displays the work teaching images 904A to 904C in accordance with the progress of the target work in the moving image of the work support image 600. To be more specific, the display device 50A changes the work teaching images 904A to 904C in accordance with the progress of the work in the moving image of the work support image 600.

Accordingly, the operator or the supervisor can grasp the contents of the plurality of processes, the information (the work teaching image 904) associating the previous and subsequent processes, and the like in accordance with the actual flow of the plurality of processes. Therefore, the operator or the supervisor can more appropriately understand the contents of the plurality of processes, the information for associating the previous and subsequent processes, and the like. Therefore, the management system SYS can further improve the work efficiency and safety of the shovel 100.

In addition, in the present example, the display device 50A rewinds the content displayed in a time series in response to a predetermined input inputted through the input device 52, and displays information related to a step in a relatively previous stage among the plurality of work steps. In addition, the display device 50A advances the contents displayed in a time series in response to a predetermined input inputted through the input device 52, and displays information related to a process in a relatively subsequent stage among the plurality of work processes.

As a result, the operator or the supervisor of the shovel 100 can, as appropriate, attentively check a portion desired to be checked in a time series many times or skip a portion which does not need to be checked in the work support image 900 as a moving image as appropriate. Therefore, the management system SYS can improve the convenience of the operator. In addition, the operator or the supervisor can more appropriately understand the work including the plurality of processes. Therefore, the management system SYS can further improve the work efficiency and safety of the shovel 100.

In addition, in this example, the display device 50A displays the work target image 903 (903A, 903B) representing the range of the work target for each of the plurality of work processes in the site in a superimposed manner on the work plane image 902 representing the site where the plurality of work processes are executed.

Accordingly, the operator or the supervisor can grasp the range of the work target (a range of a construction target) for each work process in a site where a plurality of work processes are executed, and proceed with an actual work or proceed with an actual monitoring task. Therefore, the management system SYS can further improve the work efficiency and safety of the shovel 100.

<Fifth Example of Work Support Image>

FIGS. 12 to 15 are diagrams illustrating a fifth example (work support image 1200) of the work support image displayed on the display device 50A. To be specific, FIGS. 12 to 16 are diagrams illustrating specific examples (work support image 1200) of the fourth support image displayed on the display device 50A.

As illustrated in FIGS. 12 to 15, the work support image 1200 is a moving image illustrating the contents of a work process group including an excavation work, a burying work, and a backfilling work for burying an object such as an underground pipe such as a water pipe in the ground in a top view of the shovel 100.

The work support image 1200 includes a shovel image 1201, a work plane image 1202 (an example of first image information), a work target image 1203, a work teaching image 1204, and an operation image 1205, as in the case of the above-described first example and the like.

The work target image 1203 (an example of second image information) includes work target images 1203A and 1203B.

The work target image 1203A represents a planned construction place of a hole to be constructed for embedding an object.

The work target image 1203B represents an object to be embedded.

The work teaching image 1204 includes work teaching images 1204A and 1204B.

The work teaching image 1204A represents the positional relationship between the shovel 100 and the hole to be constructed corresponding to the work target image at the start of the excavation work of the shovel 100.

The work teaching image 1204B represents temporarily placed earth and sand (earth to be removed) which is discharged in the excavation work and returned to the hole in the backfilling work. In addition, earth and sand brought in from the outside may be partially used as earth and sand returned to the hole by backfilling.

The operation image 1205 includes a seek bar as in the case of the first example and the like described above.

In the present example (FIGS. 12 to 15), the seek bar indicates that, in work support image 1200 as a moving image of four minutes in total, portions advanced by 5 seconds, 1 minute, 2 minutes 55 seconds, and 3 minutes 55 seconds from the start point are reproduced, that is, displayed on the display device 50A.

In addition, as in the case of the above-described first example and the like, by designating any position of the seek bar through the input device 52, it is possible to display an image of any place in a time series in the work support image 1200 as a moving image on the display device 50A.

In addition, as in the case of the above-described first example and the like, by designating any position of the seek bar through the input device 52, it is possible to display an image of any place in a time series in the work support image 500 as a moving image on the display device 50A.

As in the case of the above-described first example and the like, when any position in a time series of the work support image 1200 is designated on the operation image 1205 (seek bar) through the input device 52, a thumbnail image corresponding to the work support image 1200 of the position may be displayed.

The work support image 1200 includes work support images 1200A to 1200D as still images constituting one scene of the moving image.

The work support image 1200A represents a stage immediately after the start (5 seconds after the start point) in a time series in the work support image 1200 as a moving image. To be specific, the work support image 1200A represents a state in which the shovel 100 is performing a preparation process (positioning) for an excavation work for excavating a hole corresponding to the work target image 1203A. Accordingly, by checking the work teaching image 904A, the operator or the supervisor can grasp the appropriate positioning of the shovel 100 with respect to the hole corresponding to the work target image 1203A in the preparation process in advance of the excavation work.

The work support image 1200B represents an early stage (one minute after the start point) in a time series in the work support image 1200 as a moving image. To be specific, the work support image 1200B represents a state in which the shovel 100 is performing the excavation work of the hole corresponding to the work target image 1203A. Accordingly, by checking the work teaching image 904B, the operator or the supervisor can understand that it is necessary to form the earth unloading pile so as to avoid the position where the work target image 1203B (the dotted line in the drawing) corresponding to the object buried in the object burying work after the excavation work is prepared.

The work support image 1200C represents the final stage (2 minutes and 55 seconds after the start point) in the time series in the work support image 1200 as a moving image. To be specific, the work support image 1200C represents a state in which the shovel 100 is performing the work of backfilling the object buried in the burying work and corresponding to the work target image 1203B. Accordingly, the operator or the supervisor can grasp in what order the earth and sand of the plurality of earth unloading piles should be used for backfilling by confirming the work teaching image 904B.

The work support image 1200D represents a stage immediately before the end (3 minutes and 55 seconds after the start point) in a time series in the work support image 1200 as a moving image. To be specific, the work support image 1200C represents a state in which the shovel has completed the backfilling work.

As described above, in this example, the display device 50A displays, under the control of the display processing unit 303, information (the work support image 1200) related to a plurality of processes including information associating previous and subsequent processes among a plurality of processes performed by the shovel 100 in a time series. To be specific, the display device 50A displays the work support image 1200 including information (the work teaching image 1204) on how to proceed to a relatively earlier step in consideration of a relatively subsequent step in a plurality of work steps (an excavation work, a burying work, and a backfilling work) whose work order is determined in a time series.

Accordingly, even when the operator has little experience in a plurality of target work processes, the operator can proceed with a relatively earlier operation process in consideration of a relatively subsequent operation process. Similarly, even in a case where the supervisor has little experience in monitoring the target work including the plurality of work processes, the supervisor can monitor the relatively earlier operation process in consideration of the relatively subsequent operation process. Therefore, the management system SYS can relatively improve the work efficiency and safety of the shovel 100 even when an operator with a relatively low level of skill performs an operation or when a supervisor with a relatively low level of experience performs monitoring.

In addition, in the present example, the display device 50A displays the information related to the content of each of the plurality of processes and the information associating the previous and subsequent processes in a time series in accordance with the execution order of the plurality of processes. To be specific, the display device 50A displays the contents of the plurality of work processes (the excavation work, the burial work, and the backfilling work) in a time series in accordance with the order (the work support images 1200A to 1200D). For example, when the work support image 1200A corresponding to the preparation step is displayed, the display device 50A displays the work teaching image 1204A in accordance with the content of the work support image 1200A. Similarly, for example, when the work support image 1200B corresponding to the excavation work is displayed, the display device 50A displays the work teaching image 1204B in accordance with the content of the work support image 1200B.

Accordingly, the operator or the supervisor can grasp the contents of the plurality of work processes, the information (work teaching image 1204) associating the previous and subsequent work processes, and the like in accordance with the actual flow of the plurality of work processes. Therefore, the operator or the supervisor can more appropriately understand the contents of the plurality of work processes, the information associating the previous and subsequent work processes, and the like. Therefore, the management system SYS can further improve the work efficiency and safety of the shovel 100.

In addition, in the present example, the display device 50A rewinds the content displayed in a time series in response to a predetermined input inputted through the input device 52, and displays information related to a step in a relatively previous stage among the plurality of work steps. In addition, the display device 50A advances the contents displayed in a time series in response to a predetermined input inputted through the input device 52, and displays information related to a process in a relatively subsequent stage among the plurality of work processes.

As a result, the operator or the supervisor of the shovel 100 can, as appropriate, attentively check a portion desired to be checked in a time series many times or skip a portion which does not need to be checked in the work support image 1200 as a moving image as appropriate. Therefore, the management system SYS can improve the convenience of the operator. In addition, the operator or the supervisor can more appropriately understand a work process group including a plurality of work processes. Therefore, the management system SYS can further improve the work efficiency and safety of the shovel 100.

In addition, in this example, the display device 50A displays the work target image 1203 (1203A, 1203B) representing the range of the work target for each of the plurality of work processes in the site in a superimposed manner on the work plane image 1202 representing the site where the plurality of work processes are executed.

Accordingly, the operator or the supervisor can grasp the range of the work target (a range of a construction target) for each work process in a site where a plurality of work processes are executed, and proceed with an actual work or proceed with an actual monitoring task. Therefore, the management system SYS can further improve the work efficiency and safety of the shovel 100.

[Operation Method of Application Screen]

Next, FIGS. 16 to 18 are diagrams illustrating an example of an operation method of an application screen for displaying a desired work support image.

FIGS. 16 to 18 are diagrams illustrating a first example to a third example (application screens 1600, 1700, and 1800) of an application screen for searching for a desired work support image displayed on the display device 50A. Specifically, the application screen 1600 in FIG. 16 is an example of an initial screen for searching for a desired work support image. An application screen 1700 in FIG. 17 is an example of an application screen (hereinafter, referred to as an "intermediate screen" for convenience) to which a transition is made in response to an operation on the initial screen in FIG. 16. An application screen 1800 of FIG. 18 is an example of an application screen (hereinafter, referred to as a "final screen" for convenience) to which a transition is made in response to an operation on the application screen (intermediate screen) of FIG. 17.

Note that an application screen similar to the application screens 1600, 1700, and 1800 may be displayed on the output device 240 (display device) of the management device 200 or the output device 340 (display device) of the terminal device 300.

As illustrated in FIG. 16, the application screen 1600 includes a list 1601.

In the list 1601, construction sites at which the work support image can be used are arranged in the vertical direction. The list 1601 includes a name 1601A for each construction site and accompanying information 1601B related to each construction site.

The names 1601A for the respective construction sites are arranged in the vertical direction.

The accompanying information 1601B is added below the target construction site. The accompanying information 1601B includes, for example, a name of an address of the construction site, a construction period at the construction site, and a name of a company related to construction of the construction site.

The accompanying information 1601B may be switchable between a display state and a non-display state by a user's operation.

The application screen 1600 also includes a scroll bar 1602 for scrolling the list 1601 up and down in accordance with a user operation. Accordingly, it is possible to display all construction sites on the application screen 1600 while displaying the list 1601 in a font size with higher visibility.

Further, the application screen 1600 includes a cursor 1603 for selecting one construction site from the list 1601. For example, the cursor 1603 is an underline attached below the name 1601A of the selected one construction site.

In this example, an underline corresponding to the cursor 1603 is displayed at the name 1601A of the uppermost construction site ("* construction site"). In this state, when the confirming operation is performed through the input device 52, the display device 50A changes the display content from the application screen 1600 of FIG. 16 to an application screen 1700 of FIG. 17 under the control of the display processing unit 303**.

As illustrated in FIG. 17, the application screen 1700 includes a name 1701 of the construction site selected on the application screen 1600 and accompanying information 1702 related to the construction site. In addition, the application screen 1700 includes a list 1703 of a plurality of time segments in a time series of the entire construction period at the construction site and an icon 1704 representing a work support information group related to the construction process for each time segment.

In this example, the time segment of the list 1703 is a segment in weeks. In addition, the division may be a unit such as one day or several days. In addition, the unit of the time division may be set (switched) by a user's operation through the input device 52.

The icon 1704 is, for example, a group of thumbnails for each work support image. When the work support image is a moving image, a part or the whole of the thumbnail of the icon 1704 may be displayed as a moving image.

In addition, the application screen 1700 includes a scroll bar 1705 for scrolling the list 1703 and the icons 1704 attached to the list 1703 to the left and right according to an operation of the user. Accordingly, it is possible to display all the time segments on the application screen 1700 while displaying the list 1703 and the icons 1704 in sizes with higher visibility.

In addition, on the application screen 1700, a cursor 1706 surrounding one time segment of the plurality of time segments of the list 1703 and the icon 1704 associated with the time segment is fixed at the center portion in the horizontal direction.

In this example, "construction period third week" is selected from among the time segments included in the list 1703. When a confirming operation is performed through the input device 52 in this state, the display device 50A transitions the display content from the application screen 1700 of FIG. 17 to an application screen 1800 of FIG. 18 under the control of the display processing unit 303.

As the time division, for example, a relatively long division in units of years or months and a relatively short division in units of weeks or days obtained by further dividing the relatively long division may be provided. In this case, for example, a first application screen on which a list of time divisions in units of months is displayed and a second application screen on which a list of time divisions obtained by further dividing the time division selected on the first application screen into units of weeks or several days is displayed are provided. In addition, when one time segment is selected and determined from the time segments in units of months on the same application screen, the time segments in units of weeks or several days included in the time segment may be expanded and displayed. Further, the time division may be divided according to a time-series work process of the construction site. This work process is a process representing a work for a period relatively longer than a period required for a plurality of processes targeted by the work support image. The work processes at the construction site include, for example, a large classification work process (hereinafter, referred to as a "large process" for convenience), a medium classification work process (hereinafter, referred to as a "medium process" for convenience) obtained by finely classifying the large classification work process, and a small classification work process obtained by finely classifying the medium classification work process. For example, the large process is a work process in units of several months, the medium process is a work process in units of several weeks, and the small process is a work process in units of several days to one week. In this case, the screen corresponding to the application screen 1700 is divided into, for example, an application screen including a list of large processes, an application screen including a list of medium processes, and an application screen including a list of small processes. To be specific, when one large process is selected and confirmed on the application screen including the list of large processes by the user, the display device 50A displays the application screen including the list of medium processes included in the selected large process under the control of the display processing unit 303. Subsequently, when one medium process is selected and confirmed on the application screen including the list of medium processes by the user, the display device 50A displays an application screen including a list of small processes included in the selected medium process under the control of the display processing unit 303. When one sub-process is selected by the user on the application screen including the list of sub-processes, an application screen including a list of work support images for a task (process) to be processed in the selected sub-process is displayed as in the case of the application screen 1800. Further, the screen corresponding to the application screen 1700 may be realized as one application screen including a list in which the large process, the medium process, and the small process are hierarchized in this order.

As illustrated in FIG. 18, the application screen 1800 includes the name 1801 of the construction site selected on the application screen 1600 and the accompanying information 1802 related to the construction site, and the application screen 1800 includes the time segment 1803 ("construction period third week") selected on the application screen 1700. The application screen 1800 includes lists 1804, 1805 of work support images and character information 1806, 1807 corresponding to each of the lists 1804, 1805.

In the list 1804, icons 1804A representing work support images of unprocessed tasks (processes) among tasks (processes) to be processed in the time segment 1803 are arranged in the left-right direction. For example, the icon 1804A is a thumbnail of the work support image. In addition, the icon 1804A may reproduce a moving image corresponding to the work support image in a state where the cursor 1809B is selected by a cursor 1809B described below.

In the list 1805, icons 1805A representing work support images of processed tasks (processes) among tasks (processes) to be processed in the time segment 1803 are arranged in the left-right direction. For example, the icon 1805A is a thumbnail of the work support image. In addition, the icon 1805A may reproduce a moving image corresponding to the work support image in a state where the cursor 1809B is selected by a cursor 1809B described below.

In addition, the application screen 1800 includes a scroll bar 1808 for scrolling the selected one of the list 1804 and the list 1805 in the horizontal direction in accordance with an operation of the user. Accordingly, it is possible to display the icons 1804A of all the work support images on the application screen 1800 while displaying the lists 1804, 1805 in a size with higher visibility.

In addition, the application screen 1800 includes a cursor 1809A for selecting one of the lists 1804, 1805. For example, the cursor 1809A is an underline added below any one of the pieces of character information 1806, 1807 representing the respective lists 1804, 1805. In this example, the cursor 1809A is added under the character information 1806 ("unprocessed task") and the list 1804 is selected.

In addition, the application screen 1800 includes a cursor 1809A for selecting one work support image (the icon 1804A or the icon 1805A) from one list selected by the cursor 1809B in the lists 1804, 1805.

In addition, the application screen 1800 is provided with a cursor 1809A for selecting one work support image (the icon 1804A or the icon 1805A) from one list selected by the cursor 1809B among the lists 1804, 1805, and the cursor 1809B is provided on the application screen 1800. On the application screen 1800, the cursor 1809B is fixed at the center in the left-right direction of the list 1804 or the list 1805. Accordingly, the user can cause the display device 50A to display a desired work support image by scrolling the list 1804 or the list 1805 in the left-right direction using the input device 52 and positioning the cursor 1809 on the desired work support image to determine the desired work support image.

As described above, the work support image in the storage unit 2102 is associated with the information on the construction site where the work corresponding to the work support image is performed and the information on the time when the work corresponding to the work support image is performed in all the machines of the construction site. Specifically, in the storage unit 2102, a work support image database configured by a record data group including identification information, link information, address information, and the like of a work support image, information on a construction site, and information on a time may be constructed. Accordingly, the display processing unit 303 can display the application screens 1600, 1700, and 1800 on the display device 50A in cooperation with the management device 200.

In addition, the work support image database may be updated according to the progress status of the work at the construction site. For example, the gap between the progress schedule of the construction site and the actual progress situation is periodically grasped, and the information on the time in the work support image database is updated in accordance with the gap. Accordingly, for example, even in a case where the execution date of the specific work of which the user is in charge is shifted due to a gap between the progress schedule and the actual progress situation, it is possible to provide an appropriate work support image to the user at an appropriate timing by updating the information regarding the time.

As described above, in the present example, the user can select a desired work support image and cause the display device 50A or the like to display the work support image by limiting the work site or the time using the input device 52 or the like and using the application screens 1600, 1700, and 1800.

OTHER EMBODIMENTS

Next, other embodiments will be described.

The above-described embodiment may be modified or changed as appropriate.

For example, in the above-described embodiment, the functions of the work support image generation unit 2101 and the storage unit 2102 may be transferred to the controller 30 (an example of an information processing device) or the terminal device 300 (an example of an information processing device) of the shovel 100. In this case, the management device 200 may transmit necessary data or a control command to the shovel 100 or the terminal device 300 through the communication device 220, and the controller 30 or the terminal device 300 (the control device 310) may generate a work support image in accordance with the data or the control command received from the management device 200.

For example, in the above-described embodiments and the like, the main pump 14 and the pilot pump 15 may be driven by another motor (for example, an electric motor) or the like instead of or in addition to the engine 11. That is, the shovel 100 may be a hybrid shovel, an electric shovel, or the like in which the main pump 14 and the pilot pump 15 are driven by an electric motor.

Further, for example, in the above-described embodiment and the like, the shovel 100 may be configured such that some of the driven elements such as the lower traveling body 1, the upper pivot body 3, the boom 4, the arm 5, and the bucket 6 are electrically driven. That is, the shovel 100 may be a hybrid shovel, an electric shovel, or the like in which a part of driven elements is driven by an electric actuator.

Further, for example, in the above-described embodiment and the like, the management system SYS may include another work machine instead of or in addition to the shovel 100. In this case, the management system SYS distributes the work support image related to the work of the other work machine to the other work machine and the terminal device 300. Other work machines include, for example, bulldozers, wheel loaders, mobile cranes, and the like.

[Action]

Next, action of the present embodiment will be described.

In the present embodiment, the management system SYS includes a storage unit (for example, the storage unit 2102) and a display unit (for example, the display device 50A, the output device 240, or the output device 340). Specifically, the display unit stores information (for example, a work support image) related to a plurality of processes including information associating previous and subsequent processes among a plurality of processes performed by the work machine (for example, the shovel 100) in a time series. The display unit displays information on the plurality of processes.

Accordingly, for example, even in a case where the operator has little experience with the work, the operator can perform the work while understanding the connection between the plurality of processes performed in a time series. In addition, for example, even in a case where the supervisor has little experience in the monitoring operation of the work, the supervisor can monitor the work while understanding the connection between the plurality of processes performed in a time series. Therefore, even in a case where an operator with a relatively low degree of skill performs an operation or a case where a supervisor with relatively little experience performs monitoring, it is possible to relatively improve the work efficiency and safety of the shovel 100.

Further, in the present embodiment, the plurality of steps may be a plurality of work steps that can be performed in at least two or more different orders in a time series. The information for associating the previous and subsequent steps may include information related to the setup of the plurality of work steps.

As a result, for example, even when the operator has little experience work at the site, the operator can advance the actual work after grasping the setup of the plurality of work processes in advance. In addition, for example, even when the supervisor has little experience in the monitoring work, the supervisor can perform the actual monitoring work after grasping the setup of the plurality of work processes in advance. Therefore, even in a case where an operator with a relatively low degree of skill performs an operation or a case where a supervisor with relatively little experience performs monitoring, it is possible to relatively improve the work efficiency and safety of the shovel 100.

In addition, in the present embodiment, the order of the plurality of steps may be determined in a time series. The information for associating the previous and subsequent steps may include information on how to proceed to the relatively previous step in consideration of the relatively subsequent step among the plurality of steps.

Accordingly, for example, even when the operator has little experience in the work, the operator can proceed with the previous work step in consideration of the subsequent work step. In addition, for example, even when the supervisor has little experience in the monitoring operation of the work, the supervisor can monitor the previous work process in consideration of the subsequent work process. Therefore, even in a case where an operator with a relatively low degree of skill performs an operation or a case where a supervisor with relatively little experience performs monitoring, it is possible to relatively improve the work efficiency and safety of the shovel 100.

In addition, in the present embodiment, the plurality of processes may be a plurality of work processes whose work order is determined in a time series. The plurality of processes may be a predetermined work process and a preparation process in advance of the predetermined work process. Further, the plurality of steps may be a series of a plurality of operation steps constituting one work step.

Accordingly, it is possible to relatively enhance the work efficiency and safety of the shovel 100 in accordance with a plurality of processes in various forms.

In addition, in the present embodiment, the display unit may display the information related to the content of each of the plurality of processes and the information associating the previous and subsequent processes in a time series in accordance with the execution order of the plurality of processes.

Accordingly, for example, the operator or the supervisor can grasp information (for example, the work teaching image 404 or the like) which associates the contents of the plurality of processes or the previous and subsequent processes in accordance with the actual flow of the plurality of processes. Therefore, the operator or the supervisor can more appropriately understand the contents of the plurality of processes, the information for associating the previous and subsequent processes, and the like. Therefore, the working efficiency and safety of the shovel 100 can be further improved.

In addition, in the present embodiment, the management system SYS may include an input unit (for example, the input device 52, the input device 230, or the input device 330) capable of receiving an input from a user. Then, the display unit may rewind the content displayed in a time series in response to a predetermined input inputted through the input unit, and display information related to a step of a relatively previous stage among the plurality of steps. In addition, the display unit may postpone the content displayed in a time series in response to a predetermined input inputted through the input unit, and may display information related to a relatively subsequent stage among the plurality of steps.

As a result, for example, the operator or the supervisor can, as appropriate, attentively check a portion desired to be checked in a time series many times or skip a portion which does not need to be checked in information on a plurality of steps as a moving image or a slide show as appropriate. Therefore, the management system SYS can improve the convenience of the operator. In addition, for example, the operator or the supervisor can more appropriately understand work including a plurality of processes. Therefore, the working efficiency and safety of the shovel 100 can be further improved.

In addition, in the present embodiment, the display unit may display the second image information (for example, the work target images 603, 903, and 1203) representing the range of the work target for each of the plurality of processes in the site in a superimposed manner on the first image information (for example, the work plane image 602, 902, and 1202) representing the site in which the plurality of processes are executed.

Accordingly, the operator or the supervisor can grasp the range of the work target (a range of a construction target) for each work process in a site where a plurality of work processes are executed, and proceed with an actual work or proceed with an actual monitoring task. Therefore, the working efficiency and safety of the shovel 100 can be further improved.

Further, in the present embodiment, the management system SYS may include an input unit capable of receiving an input from a user and a second storage unit. Specifically, the second storage unit may store information (for example, record data) that associates the information related to the plurality of processes with the information related to the construction site where the plurality of processes are performed and the information related to the time when the plurality of processes are performed in the entire period at the construction site. The display unit may display the information related to the plurality of processes in accordance with the specific construction site and the specific period in the entire period at the specific construction site designated by the input from the user received by the input unit.

With this configuration, the user can cause the display unit to display information on a plurality of desired processes by designating a specific construction site and a specific time in the entire period at the construction site using the input unit.

In addition, in the present embodiment, the management system SYS may include a generation unit (for example, the work support image generation unit 2101) that generates information regarding a plurality of processes.

Thus, the management system SYS can generate information related to a plurality of processes to be provided to the user.

Further, in the present embodiment, the management system SYS may include a predetermined device (for example, the shovel 100 or the terminal device 300) and an information processing device (for example, the management device 200) communicably connected to the predetermined device. In addition, the predetermined device may include a display unit, an input unit capable of receiving an input from a user, and a request unit (for example, the distribution request unit 301 or the distribution request unit 3101) that transmits a signal for requesting transmission of information related to the plurality of processes to the information processing device in response to a predetermined input to the input unit. The information processing apparatus may include a transmission unit (for example, the work support image distribution unit 2103) that transmits information on the plurality of processes to a predetermined apparatus in response to a signal received from the predetermined apparatus.

Thus, the user can confirm the information related to the plurality of processes stored in the external information processing apparatus by using the predetermined apparatus used by the user.

Further, in the present embodiment, the predetermined device may be a terminal device (for example, the terminal device 300) or a work machine (for example, the shovel 100) used by the user.

Thus, the user can confirm the information related to the plurality of processes stored in the external information processing apparatus by using the predetermined apparatus used by the user.

Although the embodiment has been described in detail above, the present disclosure is not limited to the specific embodiment, and various modifications and changes can be made within the scope of the gist described in the claims. They also of course fall within the technical scope of the present disclosure.

What is claimed is:

1. A support system comprising:

a hardware processor configured to electronically generate a video or a slide show of a plurality of still images related to a plurality of processes before the plurality of processes are actually performed by a work machine in a time series, the video or the slide show including associating information that associates previous and subsequent processes among the plurality of processes, the plurality of processes including movement of earth and sand on the ground, movement of earth and sand from the ground, or both;

store the generated video or slide show in a first storage before the plurality of processes are actually performed by the work machine in a time series;

extract the stored video or slide show from the first storage based on information designated by a user before the plurality of processes are actually performed by the work machine in a time series; and display the extracted video or slide show on a display before the plurality of processes are actually performed by the work machine in a time series, such that respective contents of the plurality of processes are displayed in a time series in accordance with an execution order of the plurality of processes along with the associating information; and an input unit configured to receive an input from the user, wherein the hardware processor is further configured to, in response to the input through the input unit, rewind the displayed contents to display information related to a previous process among the plurality of processes, or advance the displayed contents to display information related to a subsequent process among the plurality of processes, before the plurality of processes are actually performed by the work machine in a time series.

2. The support system according to claim 1, wherein the plurality of processes are a plurality of work processes performable in at least two or more different orders in a time series, and the associating information includes information related to a setup of the plurality of work processes.

3. The support system according to claim 1, wherein the associating information includes information on how to proceed with the previous process in consideration of the subsequent process among the plurality of processes.

4. The support system according to claim 3, wherein the plurality of processes are a plurality of work processes whose work order is determined in a time series; a predetermined work process and a preparatory process for the predetermined work process; or a series of a plurality of operation processes constituting one work process.

5. The support system according to claim 1, wherein the hardware processor is further configured to display, on the display, first image information representing a site in which the plurality of processes are performed and second image information representing a range of a work target for each of the plurality of processes in the site in a superimposed manner.

6. The support system according to claim 1, wherein the hardware processor is further configured to, before the plurality of processes are actually performed by the work machine in a time series, store, in a second storage, information associating the video or slide show stored in the first storage, information related to a construction site where the plurality of processes are performed, and information related to a time when the plurality of processes are performed in an entire period at the construction site, extract the stored video or slide show in accordance with a specific construction site and a specific time in an entire period at the specific construction site, the specific construction site and the specific time being designated by the input from the user received by the input unit, and display the extracted video or slide show on the display.

7. The support system according to claim 6, wherein the specific time designated by the input from the user is one time segment among a plurality of time segments in a time series of the entire period at the specific construction site.

8. The support system according to claim 1, further comprising:

a predetermined device; and an information processing device communicably connected to the predetermined device, wherein the predetermined device includes the display;

the input unit; and another hardware processor configured to transmit a signal requesting transmission of the video or the slide show to the information processing device in response to a predetermined input to the input unit, and the information processing device includes the hardware processor, and the hardware processor is further configured to transmit the video or the slide show to the predetermined device in response to the signal received from the predetermined device before the plurality of processes are actually performed by the work machine in a time series.

9. The support system according to claim 8, wherein the predetermined device is a terminal device used by the user or the work machine.

10. The support system according to claim 1, wherein the associating information includes setup information related to a setup of the plurality of work processes, and the hardware processor is further configured to perform reinforcement learning to generate the setup information representing such work contents as to maximize a reward related to work efficiency.

11. The support system according to claim 1, wherein the generated video or slide show further includes an image simulating the work machine, an image simulating a plane on which the work machine is positioned for work, and an image indicating a target place on which the work machine performs the work.

12. The support system according to claim 1, wherein the associating information includes numerical information indicating order of construction and an icon image indicating a target of construction.

13. The support system according to claim 1, wherein the associating information includes at least one of a point to be noted in work, a point deduction item in an evaluation of work, or a point addition item in the evaluation of work.

14. The support system according to claim 1, wherein the hardware processor is further configured to, before the plurality of processes are actually performed by the work machine in a time series, automatically extract image information from a basic image information group prepared in advance and electronically generate the video or the slide show using the extracted image information.

15. An information processing device comprising:

a hardware processor configured to electronically generate a video or a slide show of a plurality of still images related to a plurality of processes before the plurality of processes are actually performed by a work machine in a time series, the video or the slide show including associating information that associates previous and subsequent processes among the plurality of processes, the plurality of processes including movement of earth and sand on the ground, movement of earth and sand from the ground, or both;

store the generated video or slide show in a first storage before the plurality of processes are actually performed by the work machine in a time series;

extract the stored video or slide show from the first storage based on information designated by a user before the plurality of processes are actually performed by the work machine in a time series; and transmit the extracted video or slide show to display the extracted video or slide show on a predetermined device used by the user before the plurality of processes are actually performed by the work machine in a time series, such that respective contents of the plurality of processes are displayed in a time series in accordance with an execution order of the plurality of processes along with the associating information, and in response to an input from the user through an input unit of the predetermined device, the displayed contents are rewound to display information related to a previous process among the plurality of processes or advanced to display information related to a subsequent process among the plurality of processes.

16. A non-transitory computer-readable storage medium storing a computer program for causing a computer to execute a process of controlling a terminal device, the process comprising:

transmitting, before a plurality of processes are actually performed by a work machine in a time series, an electric signal to an external information processing device in response to a predetermined input, the electric signal requesting transmission of a video or a slide show of a plurality of still images related to the plurality of processes, the video or the slide show being electronically generated before the plurality of processes are actually performed in a time series and including associating information that associates previous and subsequent processes among the plurality of processes, the plurality of processes including movement of earth and sand on the ground, movement of earth and sand from the ground, or both;

receiving the electronically generated video or slide show transmitted from the external information processing device in response to the electric signal, before the plurality of processes are actually performed by the work machine in a time series;

displaying the received video or slide show on a display before the plurality of processes are actually performed by the work machine in a time series, such that respective contents of the plurality of processes are displayed in a time series in accordance with an execution order of the plurality of processes along with the associating information; and rewinding the displayed contents to display information related to a previous process among the plurality of processes or advancing the displayed contents to display information related to a subsequent process among the plurality of processes, in response to an input from a user through an input unit of the terminal device, before the plurality of processes are actually performed by the work machine in a time series.

* * * * *